US005836282A

United States Patent [19]

Mallen

[11] Patent Number: 5,836,282

[45] **Date of Patent: *Nov. 17, 1998**

[54] METHOD OF REDUCING POLLUTION EMISSIONS IN A TWO-STROKE SLIDING VANE INTERNAL COMBUSTION ENGINE

[75] Inventor: Brian D. Mallen, Charlottesville, Va.

[73] Assignee: Samsung Electronics Co., Ltd., Suwon, Rep. of Korea

[ * ] Notice: The term of this patent shall not extend beyond the expiration date of Pat. No. 5,524,586.

[21] Appl. No.: 774,275

[22] Filed: Dec. 27, 1996

[51] Int. Cl.[6] ..... F02B 53/02

[52] U.S. Cl. ..... 123/219; 123/243

[58] Field of Search ..... 123/219, 243

[56] References Cited

U.S. PATENT DOCUMENTS

| | | | |
|---|---|---|---|
| 3,548,790 | 12/1970 | Pitts | 123/243 |
| 3,637,332 | 1/1972 | McAnally | 123/243 |
| 5,524,586 | 6/1996 | Mallen | 123/243 |

FOREIGN PATENT DOCUMENTS

| | | | |
|---|---|---|---|
| 58964 | 12/1953 | France | 123/243 |
| 420860 | 12/1934 | United Kingdom | 123/243 |

*Primary Examiner*—Michael Koczo
*Attorney, Agent, or Firm*—Jones & Volentine, L.L.P.

[57] ABSTRACT

A method for reducing the exhaust pollution emissions in a two-stroke sliding vane internal combustion engine. First, fresh air is inducted into a vane cell, and fuel is injected into the cell at an ultra-lean fuel-air equivalence ratio less than about 0.65. The fuel is injected at a location such that a circumferential distance at mid-cell-height to the stator site at the onset of combustion is at least about 4 times a vane cell height at intake. The ultra-lean fuel-air combination is then compressed and thoroughly premixed prior to combustion to a dimensionless concentration fluctuation fraction below about 0.25. The ultra-lean, thoroughly premixed fuel-air combination is then combusted. The combusted fuel-air combination is purged after an expansion cycle. The premixing step prior to combustion may use inclined airfoils within the intake duct to produce counter-rotating mixing vortices.

35 Claims, 11 Drawing Sheets

METHOD OF REDUCING POLLUTION EMISSIONS IN A TWO-STROKE SLIDING VANE INTERNAL COMBUSTION ENGINE

BACKGROUND OF THE INVENTION

1. Field of the Invention

The present invention generally relates to internal combustion engines, and more particularly, to a method of reducing emissions in a two-stroke sliding vane engine wherein the vanes slide with either a radial or axial component of vane motion.

2. Description of the Related Art

The overall invention relates to the class of devices known as internal combustion engines. Internal combustion engines produce mechanical power from the chemical energy contained in the fuel, this energy being released by burning or oxidizing the fuel internally, within the engine's structure.

However, the oxidation of hydrocarbon fuels at the elevated temperatures and pressures associated with internal combustion engines produce at least three major pollutant types:

(1) Oxides of Nitrogen ($NO_x$)

(2) Oxides of Carbon (CO, $CO_2$)

(3) Hydrocarbons (HC)

Carbon dioxide ($CO_2$) is a non-toxic necessary by-product of the hydrocarbon combustion process and can only be effectively reduced in absolute output by increasing the overall efficiency of the engine for a given application. The major pollutants $NO_x$, CO, and HC contribute significantly to global pollution and are usually the pollutants referred to in engine discussions. Other pollutants, such as aldehydes associated with alcohol fuels and particulate associated with diesel engines, contribute to global pollution as well. In the last decade it has become clear that the reduction of all such pollutants is of global importance; providing an impetus for advanced research in pollution chemistry and engine design.

Production engine devices currently include piston engines, Wankel rotary engines, and turbine engines, which may be divided into two fundamental categories: positive displacement engines and turbine engines.

In positive displacement engines (piston and Wankel engines) the flow of the fuel-air mixture is segmented into distinct volumes that are completely or almost completely isolated by solid sealing elements throughout the engine cycle, creating compression and expansion through physical volume changes within a chamber.

Turbine engines, on the other hand, rely on fluid inertia effects to create compression and expansion, without solidly isolating chambers of the fuel-air mixture. Regarding pollution emissions, turbine engines have to date offered three advantageous features in most applications:

(1) lower peak combustion temperatures;

(2) extended combustion duration; and (3) leaner fuel-air ratio.

Because of these three features, pollution emissions of $NO_x$, CO, and HC are normally lower in a turbine engine than in a piston or Wankel engine. The significantly lower peak combustion temperatures—largely provided by the leaner fuel-air ratio—reduce $NO_x$ emissions by reducing the rate of formation of $NO_x$, while the extended combustion duration and leaner fuel-air ratio reduce CO and HC emissions through oxidation of these compounds.

However, one feature of turbines has limited the magnitude of $NO_x$ reduction in most designs until recently, namely that the fuel and air are not adequately mixed prior to combustion. Even if the average peak combustion temperature is low, inadequate mixing prior to combustion will significantly limit the degree of $NO_x$ reduction, an effect seen in conventional diesel and turbine engines and explained in the specification below.

Certain recent developments in the field of gas turbines, such as the turbine engines incorporating the "Double-Cone" burner, provide sophisticated means to allow adequate premixing of fuel and air prior to combustion, and have in actual production proven the validity of the theories supporting premixing as important to reducing $NO_x$ emissions. Thus, designs have been recently developed within the gas turbine engine field which simultaneously reduce $NO_x$, CO, and HC emissions to less than 25 parts per million each without catalytic exhaust treatment, or roughly a factor of 100 below the modern spark ignition piston engine.

Turbine engines, however, are not practical for most mainstream applications (e.g. automobiles) because of high cost, poor partial power performance, and/or low efficiency at small sizes, leaving positive displacement engines such as the piston and Wankel designs for these applications.

Commercially available piston and Wankel designs offer poor emissions performance and/or require catalytic converters to reduce emissions. Even with catalytic converters, pollutant output is substantially higher than desired, being on the order of several hundred to several thousand parts per million of $NO_x$, CO, and HC for most applications. In addition to high cost, a major drawback of the use of catalytic converters is that their effectiveness weakens over time, requiring inspection and replacement to maintain performance.

In light of the foregoing, there exists a need for a method of reducing emissions in a positive displacement engine towards the scale of the aforementioned advanced turbine engines, but without the need for catalytic converters.

SUMMARY OF THE INVENTION

Accordingly, the present invention is directed to a method of reducing exhaust pollution emissions in a positive displacement two-stroke sliding vane engine that substantially obviates one or more of the problems due to the limitations and disadvantages of the related art. Specifically, the engine is a two-stroke sliding vane engine, wherein the vanes slide with an axial and/or radial component of vane motion, configured in accordance with the present method to achieve a low or reduced emissions chemical environment with respect to $NO_x$, CO, and HC emissions.

Computer simulations have demonstrated that the present method has the potential to achieve $NO_x$, CO, and HC levels that are all about several hundred ppm or lower—which is roughly a factor of 10 or more below current spark ignition piston engine levels—as determined by established chemical calculations. In the context of this invention, low or reduced emissions will be defined as levels of $NO_x$, CO, and HC below that produced by mainstream, conventional spark-ignition piston engines without catalytic converters or exhaust gas treatment.

To achieve these and other advantages and in accordance with the purpose of the invention, as embodied and broadly described, the invention is a method of reducing exhaust pollution emissions in a sliding vane engine, wherein the vanes slide with an radial or axial component of vane motion, the method comprising the steps of:

(1) inducting fresh air into a vane cell;

(2) injecting fuel into the vane cell at an ultra-lean equivalence ratio less than 0.65 and at a location such that the circumferential distance at mid-cell-height to an ultra-lean combustion-initiating device (hereafter "U.C.D.") is at least about 4 times the vane cell height at intake;

(3) compressing the ultra-lean fuel-air combination while mixing to a dimensionless concentration fraction of less than 0.25;

(4) combusting the ultra-lean, mixed fuel-air combination after first communication with the U.C.D.;

(5) scavenging the combusted fuel-air combination after an expansion cycle.

With conventional positive displacement engines, a necessary tradeoff of pollutants is often encountered as the result of the fundamental chemistry governing emissions output. As an example, running a rich fuel-air ratio, which decreases $NO_x$, can increase CO and HC emissions and vice versa, because the properties of temperature, pressure, and duration often have opposing effects on concentrations of these two sets of pollutants within the environment of such engines. Utilizing the method described for this invention as applied to the vane engine geometry, this heretofore imposition of compromise on emissions performance can be eliminated, and low levels of all major pollutants can be achieved.

Other unique features possible with the sliding vane engine design have been set forth in U.S. Pat. No. 5,524,586, U.S. Pat. No. 5,524,587, U.S. Pat. No. 5,727,517 and U.S. Pat. application Ser. No. 08/605,837 filed Feb. 22, 1996 entitled "Five-Cycle Sliding Vane Internal Combustion Engine" to Mallen, such as the high power density and minimum of exposed lubrication, and further distinguish the practicality of the vane design to perform at ultra-lean fuel-air mixtures with minimal weight, maximal efficiency, and minimum pollution. The features of the present method are further summarized below in comparison to conventional engine types.

Regarding the second (fuel injecting) and fourth (combusting) steps of the present method, it is noted that conventional diesel engines do not adequately premix the air and fuel prior to combustion and thus do not achieve low $NO_x$ emissions at all power settings. Attempting to alter these diesel designs to achieve thorough premixing would result in poor combustion timing in most applications. This loss of timing would result from a major shortcoming of conventional positive displacement geometries, namely that no physical region is continuously exposed to the combustion phase. Because of this inadequacy, no practical means has been available to these geometries to initiate and reliably time the autoignition of a thoroughly-premixed ultra-lean charge, across varying speeds and conditions.

From a chemical standpoint, adequate premixing of air and fuel prior to combustion is a necessary, though not sufficient, condition to realizing low $NO_x$ emissions in a practical engine design. Diesel engines are characterized by the injection of a lean portion of fuel into the gas that is precompressed to a level sufficient for rapid autoignition. Though some mixing can be obtained in the diesel engine prior to combustion, modern studies of achievable mixing rates from existing means suggest there is insufficient time for thorough premixing to occur. Though the method of the present invention may utilize autoignition as the principle means of combusting a lean mixture, it is not technically a diesel engine, because fuel in this invention is injected and then thoroughly mixed during compression and prior to the onset of combustion. Furthermore, the injection of the fuel into the chamber occurs earlier in the cycle than in a conventional diesel engine. Yet another difference is that the fuel injection in the present inventive method is not used as a means of timing the combustion process as in a conventional diesel engine.

Regarding the combusting step of the present method, that is, combusting the mixed fuel-air combination while communicating with a U.C.D., it is noted that conventional spark-ignition positive displacement engines cannot reliably and practically combust such an ultra-lean fuel-air mixture. This is because spark-induced flame propagation is relied upon as the principle means of combustion, and an ultra-lean mixture does not permit such flame propagation to occur reliably within the very brief peak compression/expansion profile of the piston or Wankel engine geometry. For this reason, attempts to achieve reliable ultra-lean combustion across a practical range of operating speeds and conditions within conventional positive displacement engines have failed. The U.C.D. described herein effectively extends the peak compression region while providing a hot-gas injection to each vane cell to initiate and ensure combustion at the proper time and for sufficient duration. The features of the present inventive method thus permit a sliding-vane engine to operate reliably at much leaner fuel-air ratios than possible with conventional spark-ignition designs.

To summarize, in contrast to conventional spark-ignition engine performance the present inventive method can achieve reliable combustion of an ultra-lean fuel-air mixture across a practical range of engine speeds and operating conditions. Contrasted with diesel engine performance, in the present inventive method an ultra-lean fuel-air charge can be thoroughly premixed prior to the properly-timed onset of combustion. The sliding vane design also permits continuous injection of the fuel during the induction/compression process, thereby simplifying this process. The beneficial effect on emissions chemistry of these differences as well as other advantages and considerations are explained in the specification.

The present method can be used in conjunction with U.S. Pat. No. 5,524,586, U.S. Pat. No. 5,524,587, U.S. patent application Ser. No. 08/605,836 filed Apr. 22, 1996 entitled "Equivalence-Boosted Sliding Vane Internal Combustion Engine" to Mallen, and U.S. patent application Ser. No. 08/605,837 filed Feb. 22, 1996 entitled "Five-Cycle Sliding Vane Internal Combustion Engine" to Mallen, the entire disclosures of which are hereby incorporated by reference. Portions of these patents and applications are reproduced in appropriate sections below for ease of reference and discussion.

The two-stroke sliding vane design, as described herein, permits higher power-to-weight and power-to-size ratios to be achieved than with a four-stroke sliding vane design. This advantage results from significantly reduced vane acceleration and inertial forces at a given speed and engine size for the two-stroke embodiment. An important advantage of the present inventive method is that it describes a low-pollution two-stroke sliding vane engine operation which does not require injection of fuel prior to induction of fresh air into the vane cell. Thus, the exhaust gases may be scavenged with fresh air (steps 1 and 5) without concern for fuel passing into the exhaust stream and creating pollution and fuel-efficiency losses. Such operation ensures reliable low-pollution performance across a wide range of operating conditions and speeds for a two-stroke sliding vane engine.

BRIEF DESCRIPTION OF THE DRAWINGS

The foregoing and other objects, aspects, and advantages will be better understood from the following detailed description of the embodiments of the invention with reference to the drawings, some dimensions of which have been exaggerated and distorted to better illustrate the features of the invention.

DETAILED DESCRIPTION OF THE INVENTION

Reference will now be made in detail to an embodiment of a two-stroke sliding vane engine, an example of which is illustrated in the accompanying drawings, in sufficient detail to appropriately describe the method of the present invention.

In this embodiment, an engine geometry is employed utilizing reciprocating vanes which extend and retract synchronously with the relative rotation of the rotor and the shape of the chamber surface in such a way as to create cascading cells of compression and expansion, thereby providing the essential components of an engine cycle.

Figure 1A:
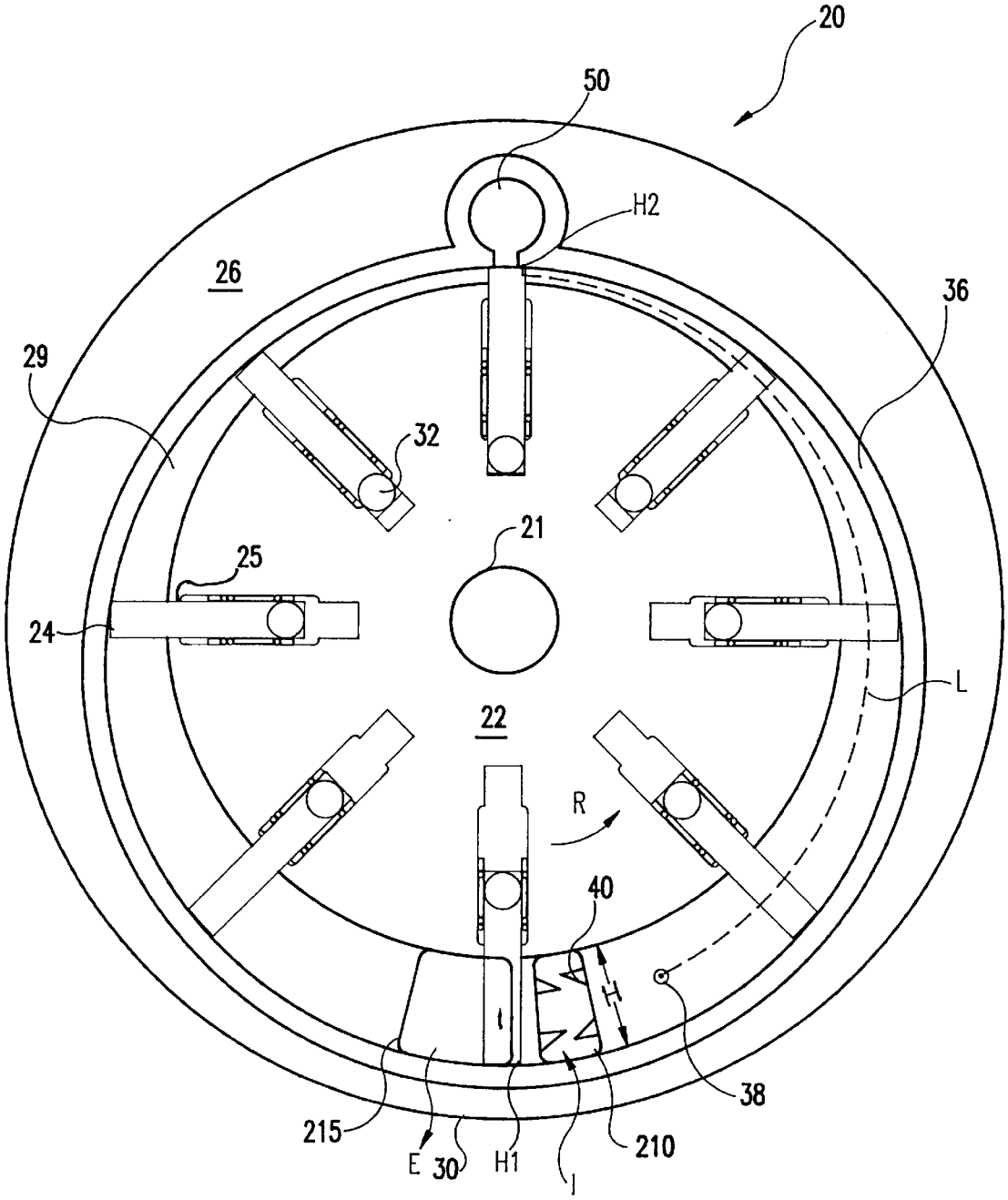
FIG. 1A is a side cross sectional view of a sliding-vane engine with a radial component of motion for the vanes usable with the method of the present invention.

An exemplary embodiment of the sliding vane engine apparatus that may be utilized with the method of the present invention is shown in FIG. 1A and is designated generally as reference numeral 20. The apparatus contains a rotor 22, rotating around rotor shaft 21 in a counterclockwise direction as shown by arrow R in FIG. 1A. The rotor 22 may also rotate in a clockwise direction. The rotor 22 houses a plurality of vanes 24 which slide within vane slots 25 in a radial direction, the vanes 24 defining a plurality of vane cells 29. A stator 26 forms the roughly circular shape of the chamber outer surface.

The illustrated engine employs a two-stroke cycle to maximize the power-to-weight and power-to-size ratios of the engine. The intake of the fresh air I and the scavenging of the exhaust E occur at the region 30, the scavenging region of the engine cycle. One complete engine cycle occurs for each revolution of the rotor 22.

Figure 2A:
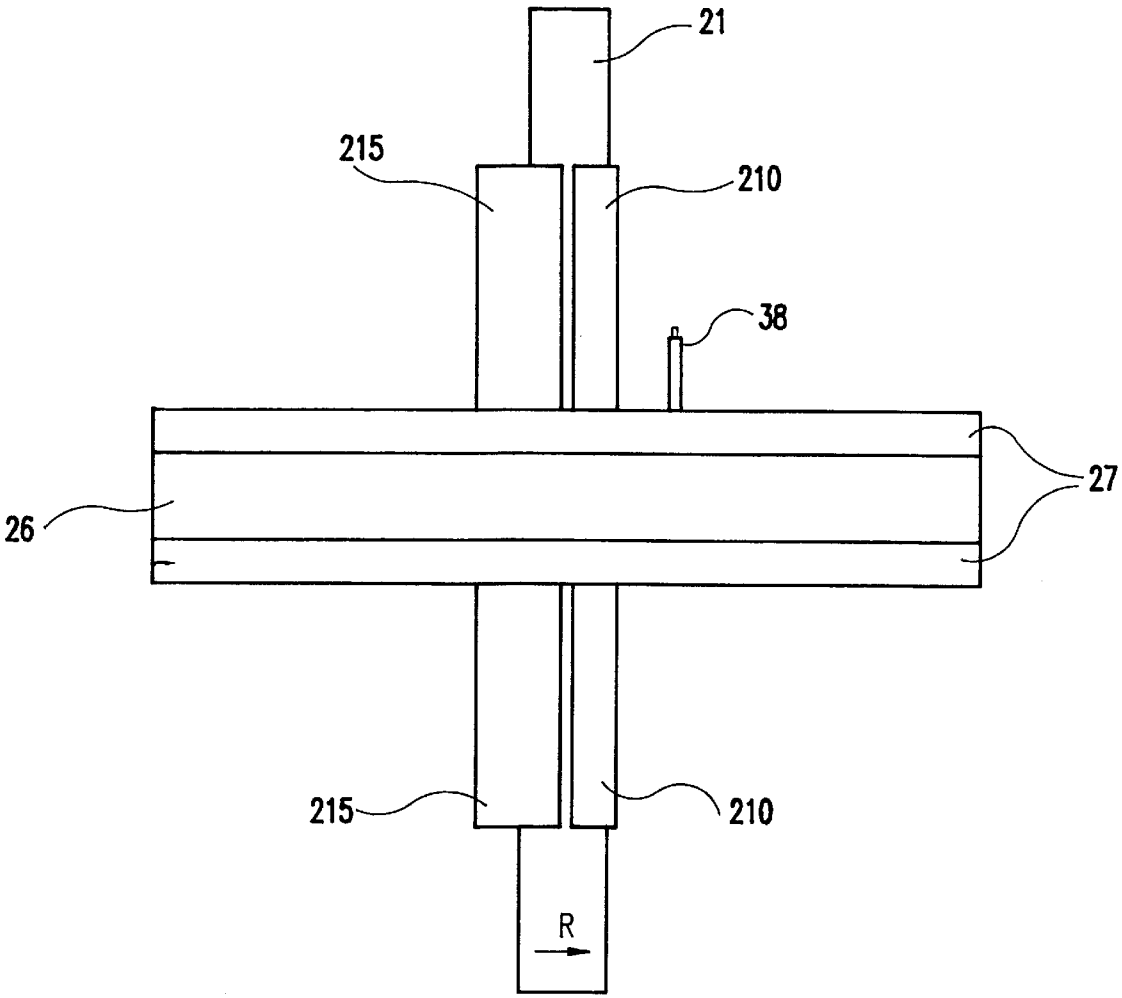
FIG. 2A is a lower exterior end view of the sliding vane engine illustrating an intake and exhaust ducting embodiment.

As shown in the exterior end view of the vane engine in FIG. 2A, the fresh air flows through a first intake means 210 at both ends of the engine, into the engine in opposing axial directions, and the exhaust gas is exhausted through exhaust means 215 at both ends of the engine.

The intake 210 and exhaust means 215 determine the scavenging region 30 as shown in FIG. 1A. The intake and exhaust means may be of various geometries, as for example, circular or square shaped conduits. The location, offset, flow angle, size and shape are selected to ensure adequate air flow, scavenging, and fuel mixing in accordance with the present method, which is described in greater detail later in the specification. One or more intake and exhaust ports may each be located at one or both axial ends and/or at the outer circumference of the engine. The scavenging region 30 need not be centered between the compression and expansion cycles, but may be offset to one side. For instance, the scavenging region may be offset to the compression side to achieve cycle overexpansion or Atkinson cycle operation, as a means to further improve thermal efficiency.

Figure 2B:
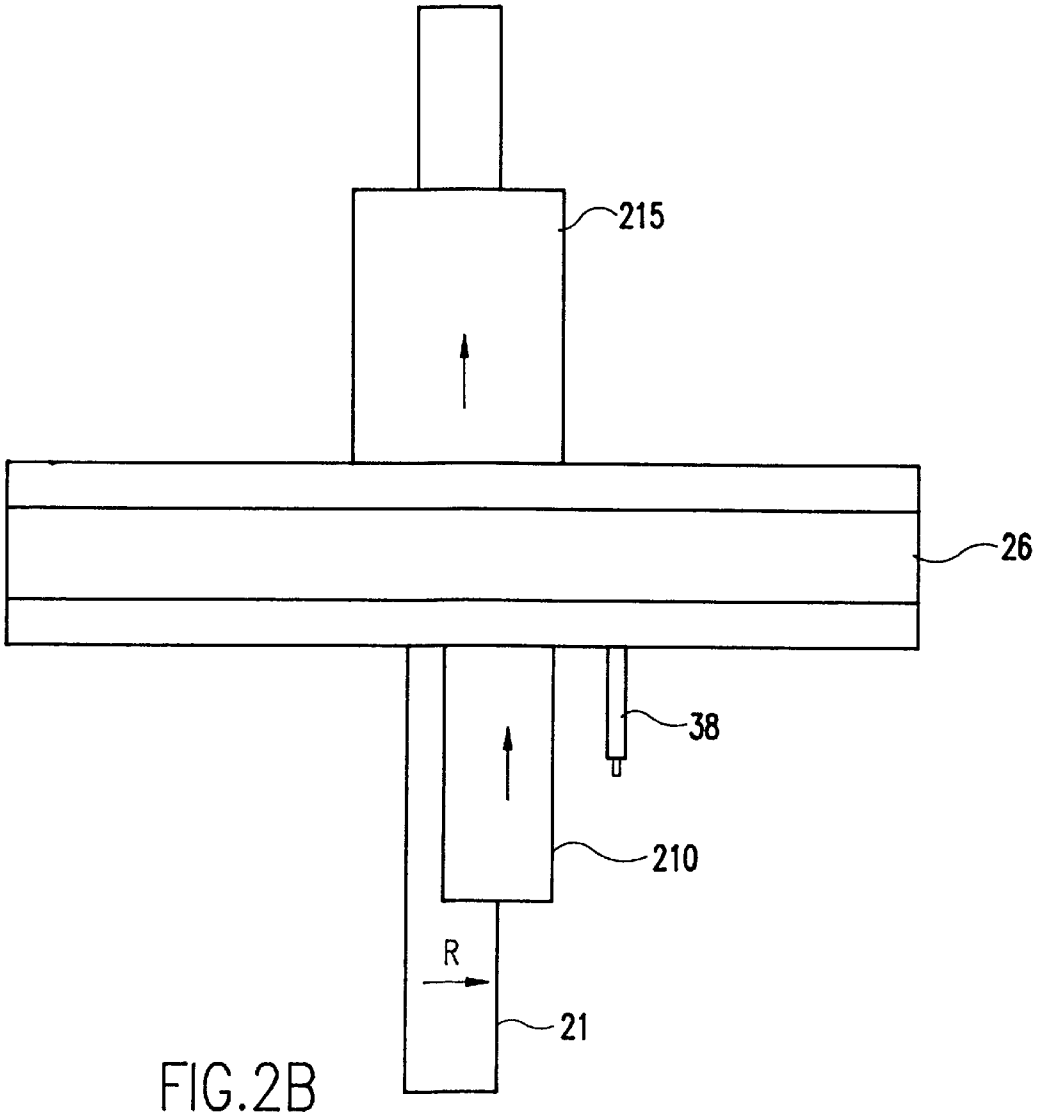
FIG. 2B is a lower exterior end view of the sliding vane engine illustrating another intake and exhaust ducting embodiment.
Figure 2C:
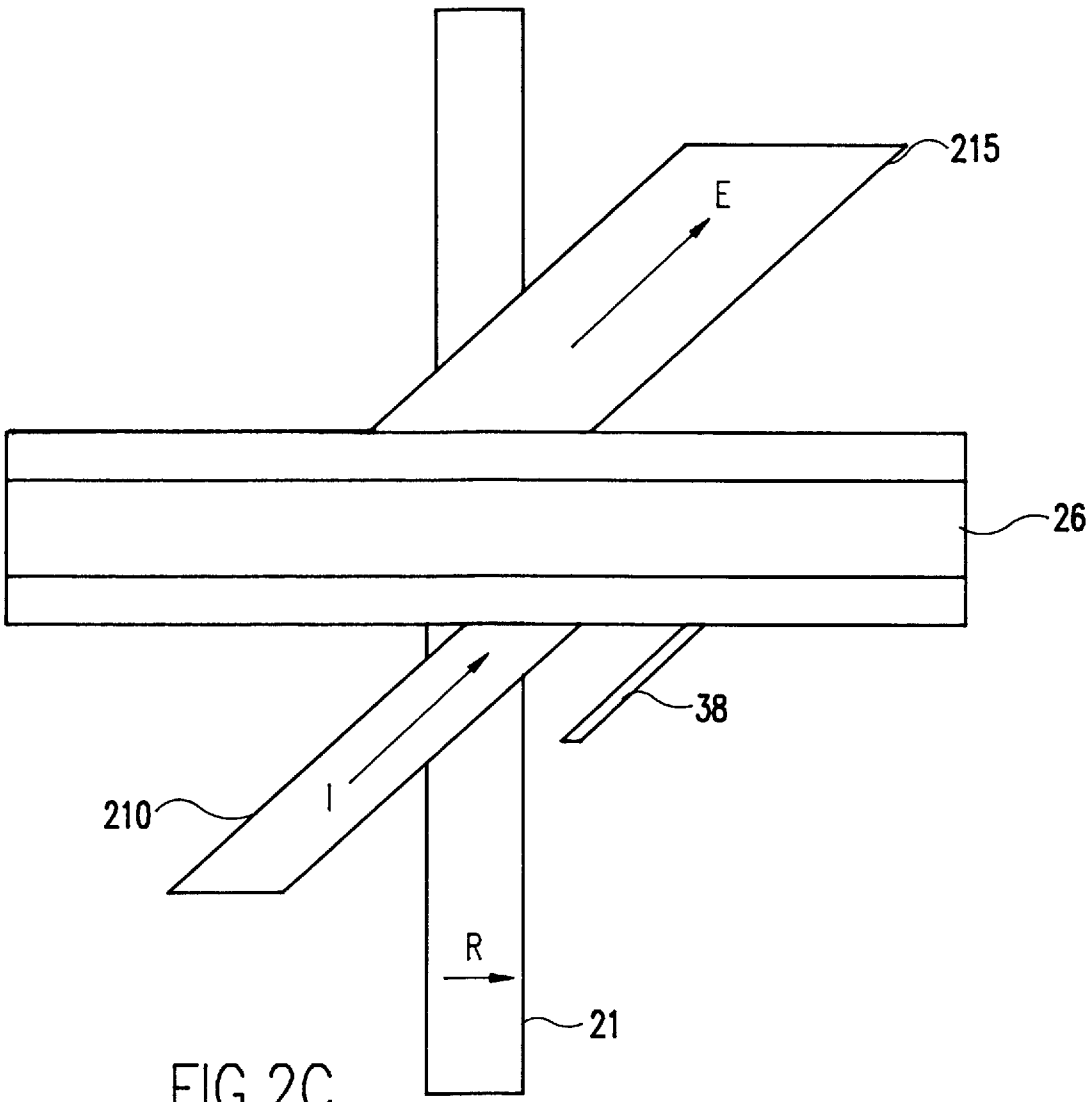
FIG. 2C is a lower exterior end view of the sliding vane engine illustrating still another intake and exhaust ducting embodiment.

For examples of these variations, referring to FIG. 2B, there is shown a single intake 210 and exhaust 215 means disposed on opposite axial ends of the stator 26. In FIG. 2C, there is shown a single intake 210 and exhaust 215 means disposed on opposite axial ends of the stator 26, and which is inclined at an angle with respect to the stator 26 and rotor. The angled orientation of the ducts in FIG. 2C has certain advantages. Since the intake flow of air is angled in the direction of the sweeping vanes as shown by the rotation R of the rotor, pressure losses are reduced since the air undergoes less direction change upon entering and exiting the engine. Also, the scavenging efficiency may be increased with the angled intake 210 and exhaust 215 duct configuration because the intake flow should entrain more exhaust gases close to the leading vane of the vane cell. The angled duct configuration of FIG. 2C may also be used with the multiple intake and exhaust ducts shown in FIG. 2A.

Figure 3A:
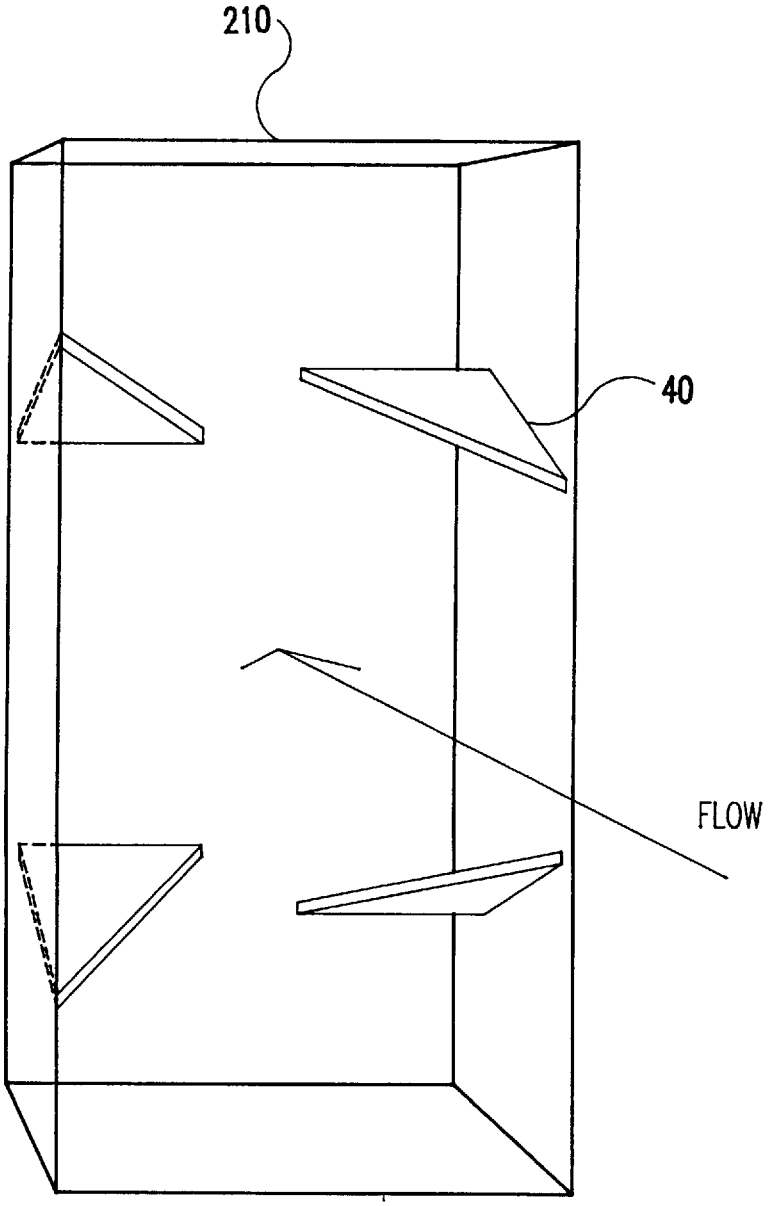
FIG. 3A is a front perspective view of the vane engine induction port illustrating vortex generators capable of providing premixing prior to the onset of combustion.

As shown in FIG. 3A, turbulence-generating devices 40 of any type may be employed before the intake region, during the intake region, after the intake region, or some combination thereof, to thoroughly mix the fuel F (from fuel injector 38) and the intake air I to achieve a fuel-air combination C. The turbulence-generating devices 40 function to create vortices to thoroughly mix the fuel-air combination C prior to the onset of combustion. Alternative means for providing this mixing turbulence are described more fully in U.S. Pat. No. 5,524,587. The illustrated vortex generators 40 produce counter-rotating vortices within the air stream. One or more vortices may also be produced at other intake ports, with the directions of rotation in alignment or out of alignment with other vortices. A preferred embodiment of this configuration should initially generate vortices approaching an aspect ratio of approximately 1, such that the vortex cross-sectional height and width are roughly equal within the vane cell at induction.

Figure 3B:
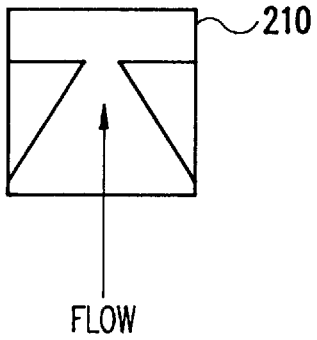
FIG. 3B is a top cross sectional view of the vortex generators of FIG. 3A.
Figure 3C:
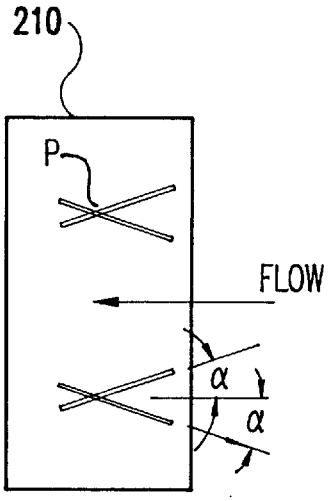
FIG. 3C is a side cross sectional view of the vortex generators of FIG. 3A.
Figure 3D:
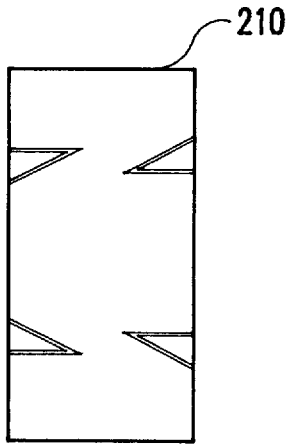
FIG. 3D is a front view of the vortex generators of FIG. 3A.

The vortex generators 40 function as low aspect-ratio airfoils inclined at an angle $\alpha$ of about 20 degrees up/down from the plane of the free stream flow which is approximately perpendicular to the duct walls of the duct 210 in the illustrated embodiment in FIG. 3C. These airfoils take the shape of delta wings with about a 60 degree leading edge sweep as shown in the top cross sectional view of the intake duct 210 in FIG. 3B. The opposing delta wings have a cross-over point 'P' at or aft of the wing's mid point as shown in FIG. 3C. With references to the side walls of the duct 210, each delta wing protrudes about 40% of the duct width into the duct as depicted in the front view of the duct 210 in FIG. 3D.

Variations of these parameters and others may further optimize the mixing performance within certain applications. Of course, smaller and larger airfoil angles $\alpha$ may be employed within the scope of the present invention. However, too small an $\alpha$, for example, less than about 10 degrees for certain applications, may not create strong enough vortices to adequately mix the fuel and air prior to combustion. While larger airfoil angles $\alpha$ may increase the mixing rate, if to large an $\alpha$, for example greater than 30–45 degrees in certain configurations, is chosen, the airflow may stall and create undesirable flow performance.

It is also understood that the vortex generators 40 may be of rectangular cross section as shown in FIGS. 3A and 3C, or they may be of conventional cambered airfoil shape, either symmetrical or asymmetrical. The cambered airfoil shape may allow higher airfoil angles $\alpha$ to be achieved prior to reaching an undesirable stall condition.

In addition, the airfoil angle $\alpha$ need not be the same for each pair of airfoils. That is, one airfoil may be inclined at a 13 degree angle while the other is declined at a 20 degree angle.

Another means of generating vortices may include one or more wedges protruding from the intake duct wall(s). Each wedge would ramp away from the duct wall in the direction of the airflow and would generate counter-rotating vortices. However, such a device is a less efficient mixer and blocks more duct area than the low aspect-ratio airfoil design described herein.

One means of controlling the sliding motion of the vanes 24 involves pins 32 as shown in FIG. 1A, which protrude from both axial ends of the vanes. These pins 32 ride within channels (not shown) incorporated in the fixed end-seal plates 27 (see FIG. 2A) of the engine. The channels are not exposed to the engine chamber and can thus be lubricated with a dry film, oil, or fuel, or combination thereof, without encountering major lubricant contamination problems. Other means of guiding the vanes may also be used within the present inventive method.

The tips of the vanes need not contact the chamber surface of the stator 26. Thus, oil lubrication need not be supplied to the stator surface, thereby permitting higher wall temperatures and significantly improved thermal efficiency, as well as reducing HC and CO emissions. One or more high-temperature insulation liners 36 as shown in FIG. 1A may be employed to provide higher chamber surface temperatures on exposed stator surfaces. While the method of the present invention significantly reduces $NO_x$, CO and HC emissions, if a hydrocarbon based lubricant is used at the stator surface, the levels of CO and/or HC emissions would be elevated compared to levels without such lubricant. U.S. patent application Ser. No. 08/605,837, identified above, describes a rolling interface vane-to-slot design which reduces the requirement for lubricant within the engine. One of ordinary skill in the art would understand that in addition to minimizing oil lubrication, the designer should seek to optimize the compression ratio and minimize wall cooling, crevice volumes, and non-recirculated blowby gases in order to optimize the reduction of CO and HC emissions within the practice of this invention.

Figure 4:
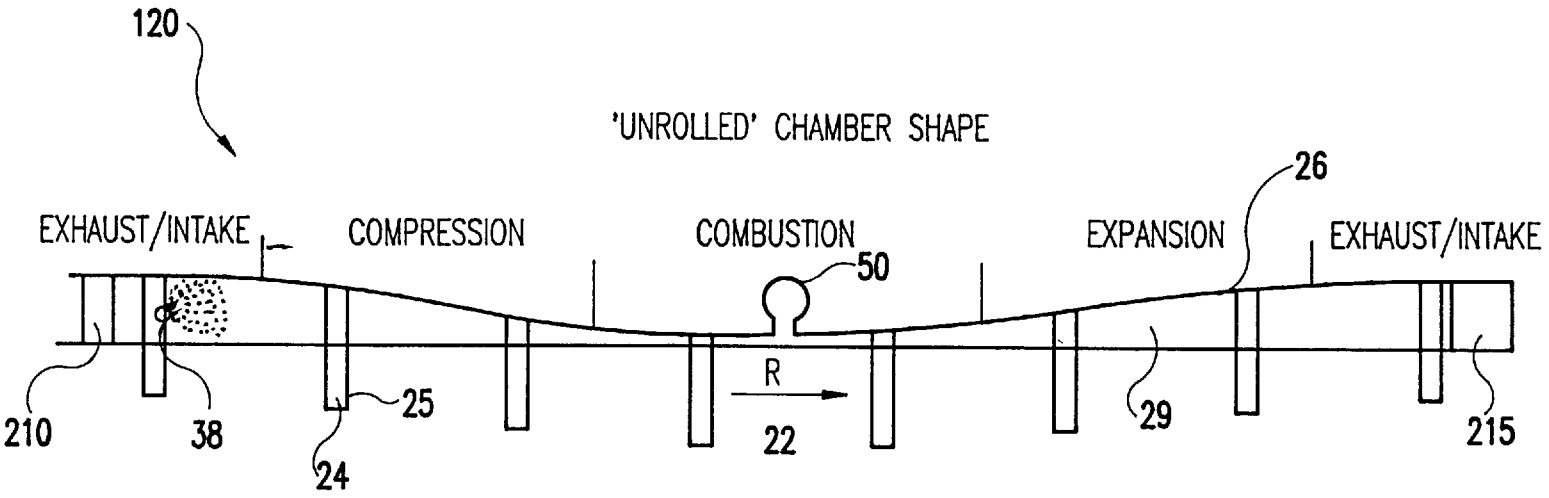
FIG. 4 is a diagram illustrating the stages of intake, compression, combustion, expansion, and exhaust with regard to a straightened rotor shape, which could apply to a sliding-vane engine with an axial, radial, or combination thereof, motion for the vanes.

FIG. 4 illustrates how the embodiment would appear if the rotor were unrolled or straightened. It is thus representative of alternate embodiments wherein the vanes slide with an axial component of vane motion, or with a vector that includes both axial and radial components. It is apparent that the vanes in FIG. 4 may also be oriented at any angle in or orthogonal to the plane illustrated, whereby the vanes would also slide with a diagonal motion in addition to any axial or radial components. The vanes may also be arcuately curved and reciprocate within like-curved slots. Any number of vanes may be employed and the number may help optimize the performance for a given application. Chambers may also be present on both sides of the rotor 22 illustrated in FIG. 4.

Specifically, the apparatus of FIG. 4 is designated generally as reference numeral 120 and contains the same components as the apparatus of FIG. 1A. Wherever possible, the same reference numerals are used throughout to refer to the same or like parts. The apparatus of FIG. 4 contains a rotor 22, rotating in relation to the stator in the direction shown by arrow R. The rotor 22 may also rotate in relation to the stator in the opposite direction. The rotor 22 houses a plurality of vanes 24 which slide within vane slots 25 in an axial direction as illustrated, the vanes 24 defining a plurality of vane cells 29. A stator 26 forms the chamber outer contour surface and this shape or contour may take any number of forms within the practice of the present inventive method.

The method may be applied to engines with one or more chambers or complete cycles per revolution. The method may also apply to an engine wherein the relative motion of rotor and stator are maintained, but where the "stator" actually rotates and the "rotor" is actually fixed, or where both rotate in opposite relative motion. The method may also be applied to an embodiment wherein the rotor envelopes the stator with the vanes pointing with a radially inward component toward the inner stator, which would take the shape of a cam, rather than pointing outward toward a stator shell as illustrated in FIG. 1A.

The complete two-stroke engine cycle is illustrated in FIG. 4, and functions in the same manner as the two-stroke cycle described above with reference to FIGS. 1–3, and therefore will not be discussed further here. Note that the steps of this method will also apply to a four-stroke cycle within a sliding-vane engine. However, the advantage of injecting fuel after fresh-air induction is not prominent with the four-stroke design, and so conventional fuel induction and premixing prior to fresh air induction may be readily employed therein.

With the above general description of the embodiments providing illustrative examples, the operation of the method according to the present invention will now be described with reference to FIGS. 1–3. The method of the present invention may be used with any type of fuel or fuel blends including, for example, conventional gasoline, diesel fuels, kerosene, natural gas, methane, alcohol-type fuels such as methanol and ethanol, and hydrogen. For simplicity and ease of discussion, the generic term "fuel" is used throughout the specification.

The first method step involves inducting fresh air into a vane cell. The fresh air charge need not be entirely fresh air, but may also include, for example, recirculated exhaust or blowby gases. Technically, any intake charge which contains an effective oxidizer for the fuel may be taken as the "fresh air". The fresh air may also include unburned fuel, either injected for later combustion or transported from leakage from the preceding engine cycle(s) to be recirculated and burned within the proceeding engine cycle(s). As will be explained in a later section describing the scavenging process, any means in the art of air movement may be used to promote such fresh air induction. As stated, turbulence generating devices such as vortex generators 40 may be employed within the induction process to produce mixing of air and fuel prior to the onset of combustion, after the fuel is injected, as governed by the parameters of the steps of the present inventive method and explained further below.

The second method step involves injection of an ultra-lean fuel charge into the vane cell at a proper location to permit thorough mixing. One or more fuel injecting devices 38 may be used and may be placed on one or both axial ends of the chamber and/or on the outer or inner circumference to the chamber. Each injector 38 may be placed at any position and angle chosen to facilitate equal distribution within the cell or vortices while preventing fuel from escaping into the exhaust stream. The injector(s) 38 may be placed in the intake port air flow, though it is more desirable to place the injector downstream of this flow, an example of which is shown in FIG. 1A to ensure unburned fuel does not exit the exhaust port. Some applications may require the injector 38 to be placed further downstream than illustrated to guard against such fuel-exhaust leakage. In the case the fuel is also used for cycle reheat, an efficiency improvement may be gained by placing the injector further downstream in the compression cycle. After injection, the turbulence produced from the turbulence or vortex generating devices 40 then thoroughly premixes the fuel and air to produce the desired premixed ultra-lean fuel-air combination C prior to the combustion phase.

The momentum from the fuel injection may be used to mix the fuel-air combination. However, mixing studies indicate that using such an approach as a sole means of mixing would prove inadequate without the aid of air vortices or turbulence, due to the relatively low momentum of the injected fuel given currently practical fuel injection velocities. The fuel may be heated from an engine source or other source of heat, prior to or during injection. Such heating of the fuel may increase vaporization and improve mixing, especially with F high density fuels. When employed as cycle reheat, the fuel heating could also increase the engine's thermal efficiency.

The fuel must be injected into the cell at a proper location to permit adequate premixing prior to combustion. Mixing is a time-dependent function. In the case of a rotating vortex, sufficient time must elapse for the vortex to complete sufficient rotation(s) for thorough mixing given all parameters. However, vortex rotation speed basically varies in proportion to the flow velocity through a duct with vortex/turbulence generators. More simply, the faster the flow through such a duct, the faster the vortices spin. Thus, the mixing function through such a duct can also be described in terms of the physical proportions of the duct, rather than the time.

Referring to FIG. 1A, the ratio of duct-length "L" to duct-height "H" should be at least about 4 and preferably greater than about 6 to permit thorough mixing to be achieved when using properly-configured, conventional vortex generating devices in an airstream. Furthermore, the mixing performance in this engine will be proportional to the vane cell height at intake, for a specified rate of compression and configuration, even though this cell height will decrease during compression. The vane cell height at intake "H" as used in the steps of the present inventive method is determined by the difference in extension of a vane between its maximum extension from the rotor at intake and its maximum retraction into the rotor. See, for example, H1 and H2 in FIG. 1A.

The duct length for this ratio then becomes the circumferential distance traveled in the vane cell from the point of injection 38 to the stator site at the onset of combustion, taken at the radial mid-height of the cell (i.e., mid-cell-high) as it progresses through compression. This is shown by the dashed line "L" in FIG. 1A.

Figure 1B:
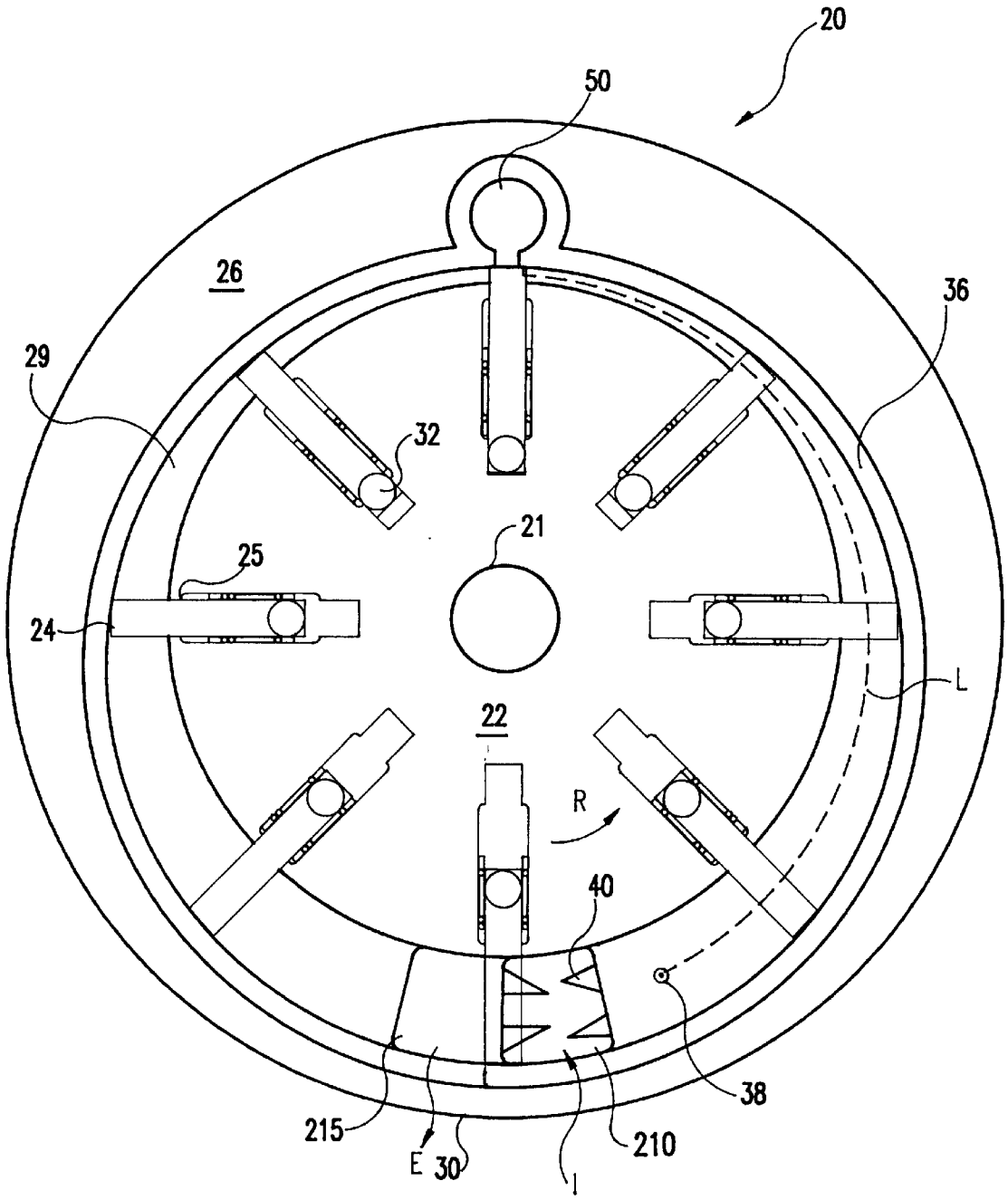
FIG. 1B is a side cross sectional view of the sliding-vane engine in FIG. 1A showing an alternate intake duct structure.

Note that the duration of fuel injection may be placed to overlap within the scavenging duration, as illustrated in FIG. 1B, provided the injector is properly aligned and/or configured with the airflow rate such that fuel does not enter the exhaust flow out of the engine.

Injection, as used herein, may mean any means of introducing the fuel to the vane cell, including, by way of example, pressure spray injection, mechanical vaporization, ultrasonic vaporization, carburetion, wick-feed, jet pumping, and other means known in the art of fluid induction and mixing. The fuel injection process may be continuous, pulsing, cycling, or intermittent within the proper parameters of the steps of the present inventive method. One or more fuel injectors may be placed on any surface providing entry to the vane cell. If more than one injector is used, the one with the maximum duct length to the stator site at the onset of combustion should be considered for the duct-length to cell-height calculation within the present inventive method. For optimum pollution performance, however, a large portion of fuel should not be injected at a location outside the parameters of the present inventive method.

In the context of the present method, an "ultra-lean" fuel-air combination, and "thoroughly premixing" are parameters that are chosen to optimize the performance of the present inventive method, and they are defined and discussed more fully below.

A first consideration in determining the optimum fuel-air intake combination and resulting mixture is a reduction in the Zel'dovich mechanism, which is a primary chemical mechanism which produces the bulk of $NO_x$ emissions in most modern positive displacement engines. This mechanism produces $NO_x$ at a local rate that depends exponentially on the local temperature of the hot gas. High rates of $NO_x$ formation are generated by the local gas temperatures associated with conventional spark ignition and compression ignition piston engines. At local gas temperatures associated with a locally ultra-lean fuel to air ratio, the Zel'dovich $NO_x$ formation be brought to low rates of formation.

If the mixture ratio of fuel to air is uniform throughout the entire volume of the combustion region, then the rate of $NO_x$ formation would be the same everywhere. Conversely, if the fuel-air mixture is not uniform at the moment of combustion, then the resulting reaction products will exist at varying temperatures, with the hottest parcels of gas producing $NO_x$ at the highest rate. For example, in an engine designed to run with a lean mixture overall, if a particular parcel of chemical reactants has somewhat more fuel than average, then that parcel will produce a locally hotter chemical product and thus more $NO_x$, a pollution-increasing effect that occurs in conventional diesel and turbine engines.

If the mixing is near optimum, then the differences in $NO_x$ production rates will be so small compared to the average production rate that the imperfect mixing will not detectably contribute to the total $NO_x$ production. However, if the mixing is relatively poor, the hottest parcels will be much warmer than the average, producing much greater $NO_x$ than average, and the imperfect mixing will have greatly contributed to the total $NO_x$ production. Therefore it is necessary to achieve an adequate level of premixing prior to combustion in order to avoid the production of additional $NO_x$, even at ultra-lean average fuel to air ratios.

A quantitative measure of the effect of nonuniform mixing on the rate of production of $NO_x$ can be estimated by defining a "dimensionless concentration fluctuation" fraction (hereafter D.C.F. fraction). The numerator is the root mean square amplitude of the fluctuations from the average in the local mixture ratio (the standard deviation), and the denominator is the absolute value of the difference between the average mixture ratio and the stoichiometric mixture ratio. As a matter of ensuring proper consistency within this calculation, these D.C.F. equation mixture terms used herein and in the steps of the present inventive method should employ the equivalence ratio or, in the case of significant diluent gases other than fresh air present, the diluent ratio. Both the equivalence ratio and the diluent ratio as used herein are defined and discussed in a later section of this specification.

When the mixing is indeed perfectly balanced in a lean-burning engine, this fraction is zero, as there are no fluctuations in the local mixture ratio. The Zel'dovich $NO_x$ is then determined by the average mixture ratio. On the other hand, when the mixing is poor, this fraction becomes much larger. Then some gas parcels could even reach the maximum possible temperature, the adiabatic flame temperature, consequently generating $NO_x$ at a much greater rate than that of the average mixture.

In order for the mixing quality to be sufficient to reduce $NO_x$ at ultra-lean fuel-air ratios, it is necessary to achieve a value for this fraction of less than about 0.25 for an equivalence or diluent ratio less than about 0.65. At lower equivalence or diluent ratios a higher D.C.F. fraction may be tolerated without comparably increasing $NO_x$ emissions because the average peak gas temperature is lower. For instance, for an equivalence or diluent ratio less than about 0.60, one should achieve a value for this fraction of less than about 0.33. As pertains to $NO_x$ emissions, the present inventive method is directed toward those zones of engine operation where low $NO_x$ levels are hardest to achieve, namely at the higher power settings for a given engine application. It is understood that a given engine may fall outside the parameters of the present inventive method during a portion of the zones of its operation while still achieving low pollution emissions. For instance, at extremely lean mixtures and thus low power settings, only a small degree of mixing and thus a relatively high D.C.F. fraction may be tolerated while still achieving low $NO_x$ emissions.

For engines which run leaner than stoichiometric, a lower D.C.F. fraction will translate into lowered $NO_x$ emissions, even at small D.C.F. fractions (though with decreasing effects). To minimize $NO_x$ emissions, a satisfactory rule would be to limit the D.C.F. fraction to a value of less than 0.10 and preferably less than 0.05. Then the additional contribution to the $NO_x$ formation due to imperfect mixing would be relatively small, which is what the mixing step seeks to achieve.

The D.C.F. fraction of the mixing step may be lowered by steps known to those skilled in the art of fuel-air mixing such as increasing the turnover rate of the mixing vortices by adjusting the design (e.g., the slope), number, position, or alignment of turbulence or vortex generating devices 40. As explained herein, sufficient duration between injection and the onset of combustion must be provided to permit thorough premixing. For further discussions of mixing performance and issues, see: Aarnio, M. J., "Mixing by turbulent streamwise vortices confined in a duct," Ph.D. thesis, University of Washington, 1994; Breidenthal, R. E., Tong, K.-O., Wong, G. S., Hamerquist, R. D., and Landry, P. B., "Turbulent mixing in two-dimensional ducts with transverse jets", *AIAA Journal*, Vol 24, 1986, pp. 1867–1869; Broadwell, J. E. and Breidenthal, R. E., "Structure and mixing of a transverse jet in incompressible flow", *Journal of Fluid Mechanics*, Vol 148, 1984, pp. 405–412; Edwards, A. C., Sherman, W. D., and Breidenthal, R. E., "Turbulent mixing in tubes with transverse injection", *AIChE Journal*, Vol 31, 1985, pp. 516–8; and EPO Application No. 91122141.4, filed Dec. 23, 1991 for "Vortex Generators For Double Cone Burner".

The concentration fluctuations from average within this engine can be measured using standard laboratory techniques, in order to arrive at an accurate determination of the D.C.F. fraction in actual operation. For example, the concentration of chemical species such as fuel or simulated fuel can be measured optically, from Raman or Rayleigh scattering from a laser.

An older technique involves gas samples suctioned through a Brown-Rebollo aspirating probe, which was developed at the California Institute of Technology, and used extensively to measure the mixing in the shear layer and the wake. More specifically, the aspirating probe, which is mounted in a opening or port in the stationary casing at one of more stations, samples gas flowing past the probe that is slowly withdrawn through the port. The probe is connected to a vacuum line, and gas is drawn through a sonic throat at the tip of the probe to flow past a hot wire downstream of the throat, operated in the constant temperature mode. The probe is basically a helium sniffer. Because of the increased thermal diffusivity of helium, which preferentially cools the hot wire, the probe accurately measures the concentration of the helium stream as long as the Mach number of the incident flow is much less than one. Either the fuel or the oxidizer streams would be simulated with a gas containing helium. The other stream would typically be air or nitrogen, without any helium.

Simulating the fuel stream with a gas stream for this measurement technique introduces three potential imperfections in the simulation which will require consideration. One, the actual density ratio of the fuel and oxidizer streams may change, which might alter the mixing rate. However, many previous experiments have shown that the density ratio has a very weak effect on entrainment and mixing as long as buoyancy effects are negligible. Nonetheless, density effects could be detected by varying the density of the stream containing helium, for example, by adding argon gas to the helium stream to raise its density. In this way, any effects of density ratio on the mixing could be determined.

The second potential imperfection in this measurement technique concerns two-phase flow if the actual engine fuel is liquid (as opposed to the helium gas used is this technique). Because of their inertia, liquid fuel droplets do not quite follow the surrounding gas flow. The Stokes number is a measure of the lag between the gas and droplet motion. As long as the droplets are sufficiently small, such that their acceleration time is small compared to the rotation period of the mixer vortices, then the droplets follow the gas flow. Thus, a simulation substituting helium gas for the fuel droplets would be accurate for sufficiently small fuel droplets.

The accuracy of the Brown-Rebollo probe is a few percent, the temporal bandwidth is a few kilohertz, and the sampling volume is approximately a cubic millimeter. The probe responds to pressure and temperature changes, not just the concentration fluctuations, so that the concentration signal could be contaminated by these thermodynamic variables as each vane cell sweeps past the probe station. This third potential imperfection fortunately can be excluded. With appropriate signal processing, such as a high pass filter or computational means, the low frequency of the vane passage can be filtered out, leaving the desired high-frequency signal of the concentration fluctuations.

Because the average peak combustion temperatures are extremely low, around or below about 2250° K, as a result of the ultra-lean mixture, the $NO_x$ emissions in this thoroughly-premixed engine will remain low due to the strongly exponential influence of temperature on Zel'dovich $NO_x$ formation rates.

An equivalence ratio (E) is used to quantify the air-to-fuel ratio in the mixture ($AFR_m$) compared to the stoichiometric air-to-fuel ratio ($AFR_{stm}$):

$$E=AFR_{stm}/AFR_m$$

The air in the above equation should be taken to be fresh air at ambient conditions. An equivalence ratio of 1.0 provides the amount of fuel which could ideally consume all of the oxygen available in the combustion process, and would thus be the maximum productive fuel to air ratio. By contrast, an equivalence ratio of 0.5 would mean that the fuel could ideally react with only 50% of the available oxygen in the fresh air, leaving the remaining oxygen and other gases in the fresh air to serve as diluent and potential oxidizer.

The ultra-lean fuel-air mixture of this invention should result in an equivalence ratio of less than about 0.65, as compared to premixed fuel-air positive displacement engines which normally operate at equivalence ratios between about 0.8 and about 1.1. Currently, most such automobile engines operate extremely close to an equivalence ratio of 1.0.

Combined with the other steps of the inventive method, the ultra-lean mixture results in a chemical environment in which $NO_x$ emissions remain extremely low and in which the CO and HC can almost entirely oxidize at the combustion site.

In the case that the constituents mixed during the premixing step prior to combustion also contain significant exhaust gases or gases other than fresh air which are not included as the combustible fuel, then it is the diluent ratio (DR) and not the equivalence ratio which describes the degree of diluent in the mixture. The diluent ratio DR is expressed as, $$DR=AFR_{stm}/GFR_m$$

where $GFR_m$ is the total non-combustible gas (G) to total fuel (F) ratio of the mixture. As above, the stoichiometric air to fuel ratio is $AFR_{stm}$. Combustible gases, such as hydrogen or methane for example, are considered to be part of the fuel (F) portion, not the gas (G) portion of the mixture. Oxidizing gases, such as oxygen, are considered part of the gas (G) portion of the mixture, not the fuel (F) portion of the mixture.

In this case of incorporating diluents other than fresh air, the diluent ratio should be less than about 0.65, and preferably less than about 0.55. Note, however, that the equivalence ratio in this case (i.e., fuel to fresh air equivalence ratio) should be less than about 1.0 and preferably less than about 0.90, in order to ensure that sufficient oxygen is present to permit near-complete combustion of the fuel.

In this case of incorporating diluents other than fresh air, the goal is to achieve the same low peak combustion temperatures through a highly diluted fuel-gas mixture while employing a lean fuel to fresh air equivalence ratio, in order to permit simultaneous minimization of the emissions of $NO_x$, CO, and HC within the described method of this invention.

The mixture ratio parameters of the present inventive method are chosen to apply to a mainstream range of operating parameters including ambient conditions, engine speeds, compression and expansion ratios, and fuel types. The peak gas temperatures at varying equivalence or diluent ratios can thus be approximated for engines operating at these normal conditions. However, a sliding vane engine may operate in a regime which significantly lowers peak gas temperatures either by incorporating means which actively intra-cool the gases during the intake, compression, and/or combustion cycles, or by operating in very low temperature ambient conditions such as may be encountered at extremely cold climates or high-altitude aircraft operation. In such cases, the equivalence or diluent ratio parameters of the present inventive method will apply to the operation of such an engine as if the engine were operating with the same peak gas temperatures but with a leaner mixture and at normal operating conditions (i.e. without active intra-cooling and at standard temperature ambient conditions). For example, a 0.70 equivalence ratio for an engine operating with sufficiently intra-cooled peak gas temperatures should be equivalent in inventive scope to the same peak gas temperatures as produced by (or predicted for) a 0.63 equivalence ratio in the same engine, but at standard operating conditions without intra-cooling. In other words, the mixture ratio of this engine operating in unusual cooling conditions at a 0.70 equivalence ratio is equivalent in the sense of inventive scope to a 0.63 equivalence ratio for the purposes of the steps of the present inventive method. In the case of significant diluent gases present other than fresh air in this example, the same leaning-mixture translation would apply to the diluent ratio.

Note that this previous discussion regarding equivalence ratio translation only applies to the unusual conditions which would produce cooler peak gas temperatures than would normally be expected.

Also note that the equivalence ratio, as referenced in the steps of the present inventive method, refers to the average equivalence ratio in the vane cell. Prior to the thorough mixing step of the present inventive method, certain parcels of the fuel-air combination will be at different equivalence ratios than other parcels. The total fuel and total air quantities will yield the average equivalence ratio. The diluent ratio references should be treated in the same fashion. The D.C.F. fraction computation, however, utilizes both local and average ratios, as previously discussed.

The compression and combustion steps will now be described and some of the terms used herein will be defined. The fuel-air combination C is compressed to about the peak compression level. It is understood that this level of compression could be at or near the peak compression level and, for ease of discussion, is referred to generally as "near-peak compression". During this compression process, the fuel-air combination C continues to mix to a suitably-low D.C.F. fraction. This continuing mixing occurs as a result of the air turbulence or vortices established within the vane cell. One or more vortices may be established by vortex generators 40 in the intake duct, or some other means for such mixing as described in U.S. Pat. No. 5,524,587. Furthermore, alternate means to achieve thorough mixing may be incorporated, provided the fuel-air combination C achieves a suitably-low D.C.F. fraction prior to the onset of combustion, as detailed in the steps of the present inventive method.

Though a conventional spark may be used in some circumstances (for example, startup) or applications to initiate the combustion process, it is expected that other or additional means discussed herein will be used to achieve complete combustion in most applications of the present inventive method.

Ultra-lean combustion-initiating devices (U.C.D.'s) include devices or features of the type which provide properly-timed hot-gas injection to an approaching vane cell to ensure the complete combustion of an ultra-lean fuel-air mixture. As explained in more detail below, examples of such devices include the combustion residence chamber, hot gas ducting, and relative chamber path retraction. Other devices or features or combinations thereof may also achieve this task of ultra-lean combustion initiation, such as for example, a near-adiabatic-temperature portion of the stator chamber surface close to the combustion site. The important point is that a region of the sliding-vane engine design can be exposed continuously to the combustion process. This geometry makes practical many means for initiating ultra-lean combustion which are not practical for the comparatively non-continuous combustion occurring within conventional piston and Wankel engines.

The combustion residence chamber 50 (see FIGS. 1 and 4) is a cavity or series of cavities within a stator location, radially and/or axially disposed from the vane cell, which communicates with the fuel-air charge at about peak compression and combustion. This cavity may be of variable volume.

Figure 5:
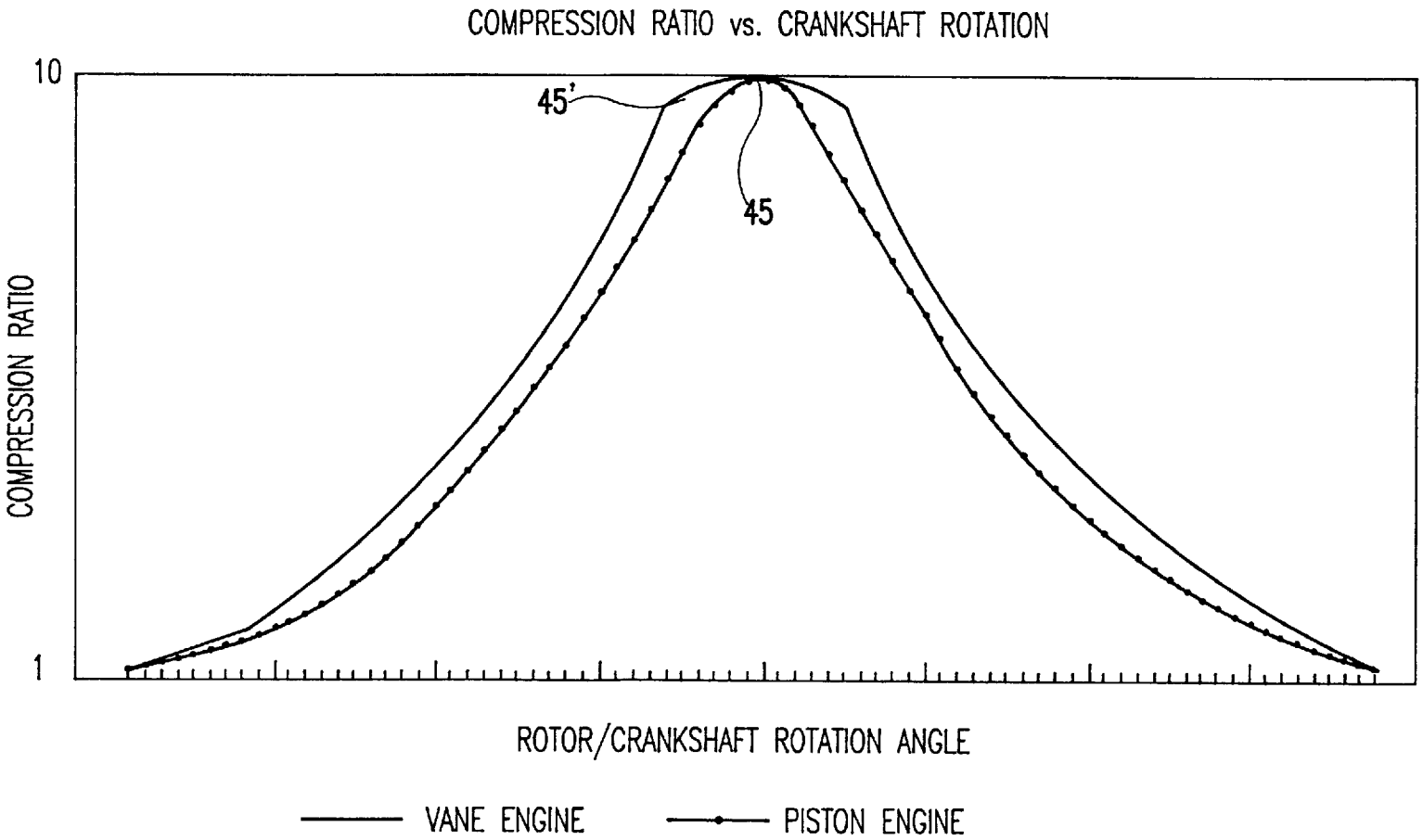
FIG. 5 is a graph depicting compression ratio profiles representative of a conventional piston engine and that of an embodiment of the present inventive method.

The effectively extended near-peak compression duration effect of the combustion residence chamber can be visualized by a comparison of the volumetric compression ratio profile of a conventional piston engine to that of the compression ratio profile of an embodiment of the present inventive method, as shown in FIG. 5. FIG. 5 is a graph showing the volumetric compression ratio on a logarithmic scale as a function of the crank-shaft or rotor rotation angle. The present inventive method may provide an effectively extended duration at the near-peak compression region, characterized by the duration at about peak compression 45', that is maintained for a vane rotor angle of about 40 degrees in the illustrated embodiment. This duration may also be considered a 'flattening' effect imparted on the peak compression curve by the additional volume of the combustion residence chamber. The particular parameters of such an extended duration at near-peak compression (e.g., the compression ratio, vane rotor angle, number of vanes) may vary considerably within the practice of this invention. What is important is that there can be a sufficient extension of duration for the peak compression region so that there is adequate time to permit complete combustion to occur within the combustion region for an appropriate range of operating speeds and conditions, with sufficient residence time at this high compression region for the CO and HC pollutants to almost fully oxidize.

Note that the shape and proportions of the cycle, as depicted in FIG. 5, are more critical than the actual temporal and angular duration of the peak compression plateau. The near-peak compression duration 45 of the conventional piston profile of FIG. 5 (dot-dashed line) is about 5% of the compression cycle duration. By contrast, the near-peak compression duration 45' of one embodiment of the present invention as shown in FIG. 5 (solid line) is approximately 20% of the compression cycle duration. This much larger proportion allows for the optimum compression ratio to be utilized at a given engine speed so that near complete combustion of an ultra-lean fuel-air mixture can be achieved across varying engine speeds and conditions, without incurring preignition. Such a result cannot be effectively accomplished by practical means within the conventional piston engine.

The flattening of the near-peak compression curve is increased as the ratio of combustion residence chamber volume to cell volume (taken at one vane cell just prior to entry to the combustion residence chamber) increases.

The near-peak compression duration need not be entirely flat, but may be somewhat tapered and/or contoured. It is important, however, that its shape and duration ensure near complete oxidation of CO and HC pollutants, without increasing $NO_x$ emissions as a consequence of elevating peak combustion temperatures, for a range of operating speeds and conditions appropriate to a given application.

Combustion is initiated and facilitated by the hot gas injection which accompanies the combustion residence chamber's communication with a vane cell. The combustion in this engine may occur from autoignition, due to the dramatic rise in temperature and pressure occurring within the vane cell when the vane cell communicates with the combustion residence chamber. When the temperature and pressure of local fuel-air charges become high enough, the charges will spontaneously react or combust. Flame propagation is another mechanism which may participate in the combustion process. A flame front may spread from a point of ignition, combusting the fuel-air charge within the vane cell in its path as the flame front propagates through the cell. The autoignition process is used within diesel engines and is timed by the fuel injection and compression ratio, while flame propagation is relied upon in spark ignition piston engines. In certain embodiments of the present inventive method, it is believed that autoignition may be used down to extremely lean fuel-air ratios, permitting the engine to be 'throttled' solely by the fuel-air ratio. The term "autoignition", as used here, does not imply that combustion occurs automatically without externally-imposed timing such as from a U.C.D., but rather that the elevated temperatures and pressures are sufficient to ensure combustion without necessarily relying on a spot-ignition device (such as a spark plug) to begin a flame front.

Specifically, autoignition, as used here, refers to the rapid combustion reaction which occurs spontaneously as a result of the temperature, pressure, residence time, and fuel type. One means to achieve this autoignition is to compress the fuel-air mixture until it basically explodes. Other means can also produce autoignition, such as sufficient hot gas injection. The important element of an autoignition component is that an ultra-lean fuel-air mixture with a low D.C.F. fraction can be combusted without necessarily relying on flame propagation from a spot-ignition source as the principle means of completing the combustion process. The essential reason for the difficulty in achieving such flame propagation through an ultra-lean mixture is due to Damköhler number effects. The high degree of mixing vorticity within this engine makes such flame propagation (but not autoignition) more difficult for extremely lean mixtures. The steps of the present inventive method will work in conjunction with flame propagation and/or autoignition as a means of obtaining combustion, and the demands of a specific application will determine the best combustion configuration. More specifically, the leaner the minimum equivalence ratio required by a given application, the more reliance need be placed on autoignition as a means of obtaining combustion.

In some cases, the distinction between autoignition and flame propagation may seem unclear. In broad terms, the temperature, pressure, residence time, and fuel type of an autoignition environment largely ensure that combustion will occur throughout the cell. By contrast, flame propagation requires that neighboring cool gases not mix so rapidly with the flame front that the front extinguishes, or that the flame front puts out enough heat to propagate through the cooler gases. The distinction between flame propagation and autoignition becomes more salient for leaner and leaner mixtures. For a discussion of Damkohler number effects on flame propagation, see "Blowout of Turbulent Diffusion Flames", J. E. Browdwell, W. J. A. Dahm, & M. G. Mungel, $20^{th}$ Symposium (International) on Combustion/The Combustion Institute, 1984, pp. 303–310. For an empirical analysis of autoignition delay times, see "Four-Octane-Number Method for Predicting the Anti-Knock Behavior of Fuels and Engines", Douaud, A. M., and Eyzat, P., SAE paper 780080, SAE Trans., vol. 87, 1978.

Adding the temporal requirement of thorough premixing to a conventional diesel design makes the autoignition process unreliable at the proper timing over a wide range of operating conditions, and it therefore becomes impractical. Flame propagation alone does not permit an ultra-lean fuel-air charge to fully and reliably combust within a conventional spark ignition piston or Wankel engine. Thus, the present inventive method brings a new cycle of positive displacement engine operation for mainstream usage, that of combusting an ultra-lean fuel-air charge which has been injected and thoroughly premixed within the vane engine prior to combustion. This new cycle brings with it the advantages of low pollution output of $NO_x$, HC, and CO.

Figure 6A:
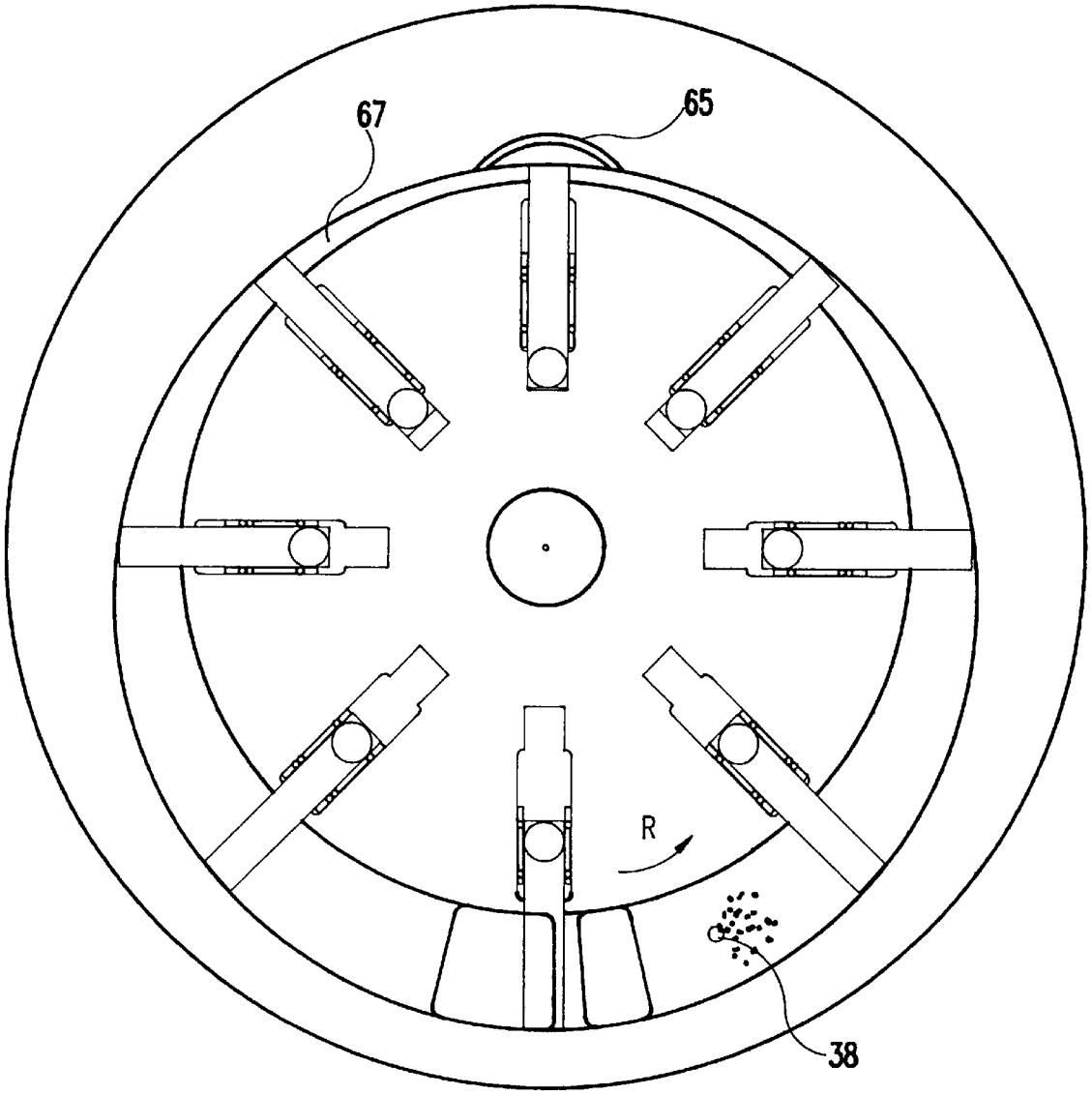
FIG. 6A is an alternate side cross sectional view of a sliding-vane engine illustrating ducting of hot combusted gases into a trailing vane cell via a distinct duct in the stator.
Figure 6B:
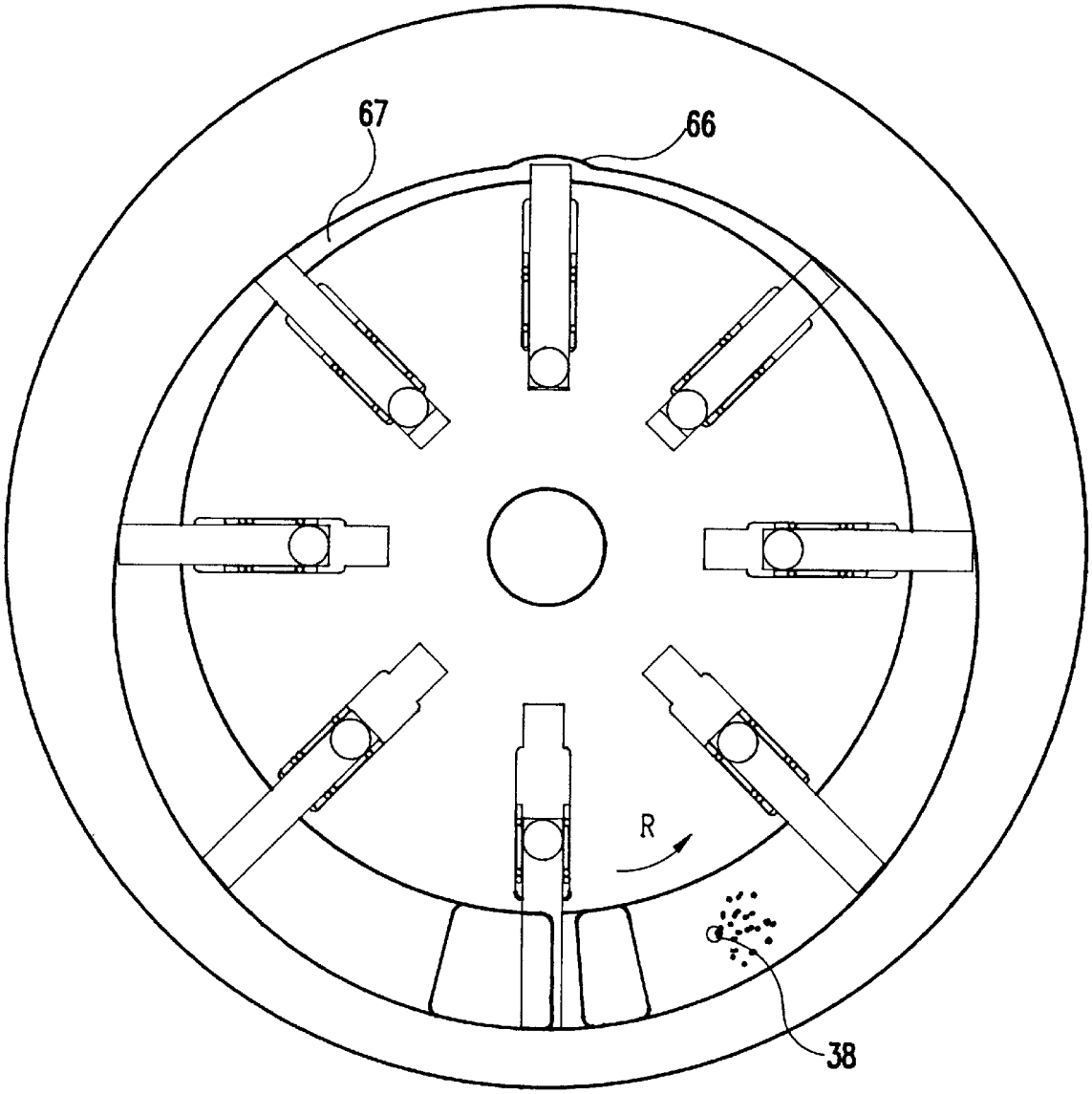
FIG. 6B is an alternate side cross sectional view of a sliding-vane engine illustrating ducting of hot combusted gases into a trailing vane cell via a relative retraction of chamber path.

One of ordinary skill in the art would understand that the combustion residence chamber 50 could take on many geometric forms within the practice of this invention. Alternatively, ducting of hot, combusted gas from the leading vane cell to the trailing vane cell would achieve a similar combustion-facilitating result of opening the trailing vane volume to the combustion temperatures and pressures. This may be accomplished by providing, for example, a porting means 65 through the stator, or a recess or relative retraction of the chamber path with respect to the vanes as shown by 66, both as shown in FIGS. 6A and 6B, respectively. In either case, for the purposes of the steps of the present inventive method, a combustion residence chamber is effectively established by this effective ducting, which effective chamber has a volume equal to that of the leading vane cell 67 at communication with the duct. Likewise, the duct length "L", as used herein, would in such case be measured in the same fashion from the point of fuel injection to the point of communication with the effective outlet duct injecting the hot gas into the incoming vane cell. Though such hot-gas ducting 65 or 66 can achieve ultra-lean combustion like the combustion residence chamber 50, the residence chamber 50 adds the potential to further extend the near-peak compression duration and/or add even greater volume to the injection process for applications which experience an especially wide range of operating speeds and/or power settings.

The U.C.D.(s) need not be centered between the compression and expansion cycles, but may be offset to one side to better optimize the combustion or cycle efficiency.

Computer simulations reveal that the combustion residence chamber volume should be at least about 10%, and preferably greater than 50%, of the cell volume at entry to the combustion residence chamber to achieve proper combustion and emissions performance within the present method, for most applications. If the combustion residence chamber volume becomes too large, then $NO_x$ emissions may begin to increase because of the increased average residence time of the large quantity of combusted gases in the combustion residence chamber. The leaner the equivalence ratio and the wider the operating speed range and conditions for a given application, the larger the combustion residence chamber volume needs to be (as a percentage of vane cell volume at entry) in order to maintain reliable combustion. Thus, an automotive application which needs to be 'throttled' to very lean equivalence ratios at low power may require a much larger combustion residence chamber volume than a power generation engine always running at one speed and at full power.

For this reason, a variable volume combustion residence chamber may be chosen using, for example, a plunger to decrease the chamber's volume at higher equivalence ratios, lower speeds, and/or other operating conditions.

The compression ratio is chosen so as to avoid autoignition substantially prior to the peak compression region at operating conditions. Choosing high compression ratios may further reduce CO and HC emissions, but may increase the $NO_x$ emissions at a given equivalence ratio. The high average chamber pressures produced by the high compression ratio may reduce rotor shaft bearing life. Thus, the designer must optimize the compression ratio for the demands of a given application within the parameters of the present inventive method. The engine designer might begin this optimization process by considering a compression ratio typical of current spark-ignition automotive engines.

As stated above, there should be a sufficient volume to the combustion residence chamber, if utilized, to permit combustion to occur for a practical range of operating speeds and conditions, with sufficient residence time at the high compression region for the CO and HC pollutants to almost fully oxidize.

Because such a combustion residence chamber or U.C.D. is not practical in conventional positive displacement engines, these engines cannot reliably combust premixed ultra-lean fuel-air charges within a wide range of operating speeds, temperatures, altitudes, etc., nor can they simultaneously allow the CO and HC to almost fully oxidize during expansion. The heavy amount of exposed oil required for piston and Wankel engine operation further compounds the CO and HC emissions problems. As a result of these reinforced limitations, mainstream positive displacement engines do not simultaneously achieve low $NO_R$, CO, and HC emissions.

Further synergistic advantages stemming from this capability to employ ultra-lean mixtures in a sliding-vane engine include the fact that such leaner mixtures combined with the high mixing vorticity reduce the probability of spot-initiated preignition from a hot surface spreading combustion throughout the mixture, because of aforementioned and referenced Damköhler number effects. Thus, the present invention permits operation with hotter walls and/or higher compression ratios to be employed without suffering preignition, thereby improving fuel efficiency and further lowering CO and HC emissions.

The CO and HC oxidation will typically occur at a temperature range below 2250° K because of the ultra-lean mixture. The equilibrium values of CO and HC pollutants are extremely low at the combustion temperatures and pressures associated with the ultra-lean mixtures. If enough residence time is available at these temperatures and pressures, the mixture will achieve these low equilibrium levels.

Conventional spark-ignition engines have near-adiabatic combustion temperatures of approximately 2850° K. Such high combustion temperatures yield extremely high equilibrium levels of CO which do not have sufficient time during the expansion process to oxidize into $CO_2$, resulting in extremely high CO emissions.

The oxidation of CO into $CO_2$ in this invention will primarily occur prior to the rapid expansion process which invariably changes the oxidation from a desirable equilibrium process to a rate controlled, kinetic process—an effect which occurs with virtually all positive displacement designs. This effect prevents the CO from reaching equilibrium at lower temperature and pressure regions within the expansion process and thus explains why conventional spark-ignition engines have such high CO emissions. Thus, this invention will allow the combusted mixture to achieve extremely low CO levels because of the ultra-lean mixtures and in many applications, the effectively extended near-peak compression duration.

Following the expansion process, exhaust gases are purged out the exhaust port(s) with fresh air during the scavenging process. The scavenging flow may be forced by one or more mechanically-driven or electrically-driven air-moving devices such as, for example, centrifugal blowers, fans, positive displacement pumps, or turbochargers. A properly configured wave-scavenging means, as explained in U.S. Pat. No. 5,524,587, could also be used. An excess flow of fresh air could be provided during this process for additional component cooling. Alternatively, a portion of the exhaust gases could remain in the vane cell following the scavenging process to serve as diluent or to raise the temperature of the mixture to aid combustion at lower power settings. A turbocharger might automatically perform this latter function as power settings are lowered. An exhaust-driven turbocharger with or without an intercooler could also be employed to raise the charge density at the intake port, thereby increasing the power density. With such a turbocharged arrangement, the spacing between the intake and exhaust ports becomes important to determining the pressure gain and scavenging performance. Turbochargers producing high pressure ratios should ideally include an intercooling means to prevent peak combustion temperatures from becoming too high, leading to a loss of power when constrained by a given low $NO_x$ emissions level.

The power of an engine employing the present inventive method could be throttled by reducing the equivalence and/or diluent ratio, as an alternative to reducing the density of the intake charge as with most current positive displacement engines with premixed air and fuel mixtures. This feature permits a range of power outputs at a given rpm, without employing the efficiency reducing step of generating a vacuum in the intake manifold at partial power settings. Thus, this feature made possible by the present inventive method could beneficially impact the overall fuel-efficiency for automotive applications, where engines are usually operated at partial-power settings. Such an efficiency gain would augment the inherent pollution reductions achievable within the present inventive method.

The method steps of the present invention realize unique and unexpected synergistic properties. First, the combination of thoroughly mixing prior to combustion an "ultra-lean" fuel-air combination and fully combusting in communication with a U.C.D. within a sliding vane engine geometry, results in reduced $NO_x$, CO, and HC emissions compared to levels currently achieved by mainstream positive displacement engines.

Each of these steps combine and interrelate to produce a result that is greater than the sum of its parts. As stated, adequate premixing at a proper location of an ultra-lean fuel-air charge prior to combustion facilitates the realization of low $NO_x$ emissions. The U.C.D. allows the ultra-lean fuel-air charge to be fully and reliably combusted which does not occur in conventional spark ignition engines. The ultra-lean fuel-air charge further allows for higher compression ratios and hotter wall temperatures to be achieved without preignition, thereby further lowering CO and HC emissions and improving fuel efficiency, thereby effectively lowering $CO_2$ emissions. Moreover, the near-peak compression region can be extended to permit ultra-lean combustion to occur over a wider range of operating speeds, power settings, and conditions, with sufficient residence time to allow the CO and HC pollutants to almost fully oxidize.

Additionally, it is the high power density of the two-stroke sliding vane geometry which allows for ultra-lean fuel-air charges to be employed without suffering the extremely heavy weight and large size per horsepower which would be associated with a piston engine if it could operate at such lean mixtures. Importantly, the vane engine design permits a U.C.D. to be practically employed, greatly enhancing the reliability and rapidity of the combustion process, and such a design cannot be practically employed within the piston and Wankel designs because no physical region is continuously exposed to the combustion phase within these conventional positive displacement designs. The sliding vane design permits continuous injection of fuel into the engine chamber, thereby avoiding the complex cyclic injection associated with diesel engines. The sliding vane design also permits dramatic reductions in the level of oil lubricants exposed to the engine cycle, thereby maximizing the pollution reductions gained by the present method and permitting higher fuel efficiency as a result of higher wall temperatures in combination with the ultra-lean mixture ratio. The present inventive method thus paves the way for a new generation of low pollution, high efficiency, and low weight and size positive displacement engines for practical mainstream utilization.

Pollution emissions may be measured directly or approximated through conventional chemical analysis. See, for example, J. B. Heywood, *Internal Combustion Engine Fundamentals*, McGraw Hill, 1988, Chapter 11; and N. K. Rizk & H. C. Mongi, "Three-Dimensional Gas Turbine Combustor Emissions Modeling", Journal of Engineering for Gas Turbines and Power, Vol. 115, July 1993, pp. 603–619, for discussions of some equations related to pollution emissions.

Many have invested a great deal of time and money in researching the possibility of using alternative, alcohol-type fuels such as methanol and ethanol to lower certain pollutants by some degree. However, these fuels are extremely expensive compared to conventional fuel, do not lower emissions by a high degree, and produce higher levels of aldehyde emissions. This invention overcomes these shortcomings by allowing conventional fuels to be employed while achieving low levels of major pollutants. Though other fuels may also be used within this invention, this invention allows low pollution emission to be achieved without changing the world's fuel supply infrastructure.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

Having thus described our invention, what we claim as new and desire to secure by letters patent is as follows:

1. A method for reducing exhaust pollution emissions in a two-stroke sliding vane internal combustion engine, having vanes that slide with at least one of a radial and axial component of vane motion, the method comprising the steps of:

inducting fresh air into a vane cell;

injecting fuel into the vane cell at an ultra-lean equivalence ratio less than 0.65 and at a location such that a circumferential distance at mid-cell-height from injection to a stator site at the onset of combustion is at least about 4 times a vane cell height at intake;

compressing the ultra-lean fuel-air combination while mixing to a dimensionless concentration fluctuation fraction of less than 0.25;

combusting the ultra-lean, mixed fuel-air combination;

scavenging the combusted fuel-air combination after an expansion cycle.

2. The method recited in claim 1, wherein said ultra-lean fuel-air combination has an equivalence ratio of less than 0.60 and a dimensionless concentration fluctuation fraction of less than 0.33.

3. The method recited in claim 2, wherein said ultra-lean fuel-air combination has an equivalence ratio of less than 0.50.

4. The method recited in claim 2, wherein said ultra-lean fuel-air combination has an equivalence ratio of less than 0.40.

5. The method recited in claim 1, wherein the dimensionless concentration fluctuation fraction is less than 0.10.

6. The method recited in claim 1, wherein the dimensionless concentration fluctuation fraction is less than 0.05.

7. The method recited in claim 1, wherein the circumferential distance at mid-cell-height from injection to the stator site at the onset of combustion is at least about 6 times the vane cell height at intake.

8. The method recited in claim 1, wherein the circumferential distance at mid-cell-height from injection to the stator site at the onset of combustion is at least about 9 times the vane cell height at intake.

9. The method recited in claim 1, further including the step of adjusting power in the engine by adjusting the equivalence ratio, wherein said adjusted equivalence ratio is less than 0.65.

10. A method for reducing exhaust pollution emissions in a two-stroke sliding vane internal combustion engine, having vanes that slide with at least one of a radial and axial component of vane motion, the method comprising the steps of:

inducting fresh air into a vane cell;

injecting fuel into the vane cell at an ultra-lean equivalence ratio less than 0.65 and at a location such that a circumferential distance at mid-cell-height from injection to an ultra-lean combustion-initiating device is at least about 4 times a vane cell height at intake;

compressing the ultra-lean fuel-air combination while mixing to a dimensionless concentration fluctuation fraction of less than 0.25;

combusting the ultra-lean, mixed fuel-air combination after first communication with the ultra-lean combustion-initiating device;

scavenging the combusted fuel-air combination after an expansion cycle.

11. The method recited in claim 10, wherein said ultra-lean fuel-air combination has an equivalence ratio of less than 0.60 and a dimensionless concentration fluctuation fraction of less than 0.33.

12. The method recited in claim 11, wherein said ultra-lean fuel-air combination has an equivalence ratio of less than 0.50.

13. The method recited in claim 11, wherein said ultra-lean fuel-air combination has an equivalence ratio of less than 0.40.

14. The method recited in claim 10, wherein the dimensionless concentration fluctuation fraction is less than 0.10.

15. The method recited in claim 10, wherein the dimensionless concentration fluctuation fraction is less than 0.05.

16. The method recited in claim 10, wherein the circumferential distance at mid-cell-height from injection to the ultra-lean combustion-initiating device is at least about 6 times the vane cell height at intake.

17. The method recited in claim 10, wherein the circumferential distance at mid-cell-height from injection to the ultra-lean combustion-initiating device is at least about 9 times the vane cell height at intake.

18. The method recited in claim 10, wherein during the combusting step a volume of the ultra-lean combustion-initiating device is at least 10% of the volume of the vane cell at entry to the ultra-lean combustion-initiating device.

19. The method recited in claim 10, wherein during the combusting step a volume of the ultra-lean combustion-initiating device is at least 50% of the volume of the vane cell at entry to the ultra-lean combustion-initiating device.

20. The method recited in claim 10, wherein during the combusting step a volume of the ultra-lean combustion-initiating device is at least 100% of the volume of the vane cell at entry to the ultra-lean combustion-initiating device.

21. The method recited in claim 10, further including the step of adjusting power in the engine by adjusting the equivalence ratio, wherein said adjusted equivalence ratio is less than 0.65.

22. A method for reducing exhaust pollution emissions in a two-stroke sliding vane internal combustion engine, having vanes that slide with at least one of a radial and axial component of vane motion, and incorporating effectual levels of exhaust gases, or diluent gases other than fresh air, in an intake charge, the method comprising the steps of:

inducting air into a vane cell;

injecting fuel into the vane cell at an equivalence ratio less than 1.0 and a highly-diluted dilution ratio less than 0.65, and at a location such that a circumferential distance at mid-cell-height from injection to a stator site at the onset of combustion is at least about 4 times a vane cell height at intake;

compressing the highly-diluted fuel-air combination while mixing to a dimensionless concentration fluctuation fraction of less than 0.25;

combusting the highly-diluted, mixed fuel-air combination;

scavenging the combusted fuel-air combination after an expansion cycle.

23. The method recited in claim 22, wherein said highly diluted fuel-gas combination has a diluent ratio less than 0.60 and a dimensionless concentration fluctuation fraction of less than 0.33.

24. The method recited in claim 22, wherein said highly diluted fuel-gas combination has an equivalence ratio of less than 0.90.

25. The method recited in claim 22, further including the step of adjusting power in the engine by adjusting the diluent ratio, wherein said adjusted diluent ratio is less than 0.65.

26. The method recited in claim 25, further including the step of adjusting power in the engine by adjusting the equivalence ratio, wherein said adjusted equivalence ratio is less than 1.0.

27. A method for reducing exhaust pollution emissions in a two-stroke sliding vane internal combustion engine, having vanes that slide with at least one of a radial and axial component of vane motion, and incorporating effectual levels of exhaust gases, or diluent gases other than fresh air, in an intake charge, the method comprising the steps of:

inducting air into a vane cell;

injecting fuel into the vane cell at an equivalence ratio less than 1.0 and a highly-diluted dilution ratio less than 0.65, and at a location such that a circumferential distance at mid-cell-height from injection to an ultra-lean combustion-initiating device is at least about 4 times a vane cell height at intake;

compressing the highly-diluted fuel-air combination while mixing to a dimensionless concentration fluctuation fraction of less than 0.25;

combusting the highly-diluted, mixed fuel-air combination after first communication with the ultra-lean combustion-initiating device;

scavenging the combusted fuel-air combination after an expansion cycle.

28. The method recited in claim 27, wherein said highly diluted fuel-gas combination has a diluent ratio less than 0.60 and a dimensionless concentration fluctuation fraction of less than 0.33.

29. The method recited in claim 27, wherein said highly diluted fuel-gas combination has an equivalence ratio of less than 0.90.

30. The method recited in claim 27, further including the step of adjusting power in the engine by adjusting the diluent ratio, wherein said adjusted diluent ratio is less than 0.65.

31. The method recited in claim 30, further including the step of adjusting power in the engine by adjusting the equivalence ratio, wherein said adjusted equivalence ratio is less than 1.0.

32. A method for reducing exhaust pollution emissions in a two-stroke sliding vane internal combustion engine, having vanes that slide with at least one of a radial and axial component of vane motion, the method comprising the steps of:

inducting an ultra-lean fuel-air combination into a vane cell at an equivalence ratio less than 0.65 and at a location such that a circumferential distance at mid-cell-height from injection to a stator site at the onset of combustion is at least about 4 times a vane cell height at intake;

compressing the ultra-lean fuel-air combination while mixing to a dimensionless concentration fluctuation fraction of less than 0.25;

combusting the ultra-lean, mixed fuel-air combination;

scavenging the combusted fuel-air combination after an expansion cycle.

33. A method for reducing exhaust pollution emissions in a two-stroke sliding vane internal combustion engine, having vanes that slide with at least one of a radial and axial component of vane motion, the method comprising the steps of:

inducting an ultra-lean fuel-air combination into a vane cell at an equivalence ratio less than 0.65 and at a location such that a circumferential distance at mid-cell-height from injection to an ultra-lean combustion-initiating device is at least about 4 times a vane cell height at intake;

compressing the ultra-lean fuel-air combination while mixing to a dimensionless concentration fluctuation fraction of less than 0.25;

combusting the ultra-lean, mixed fuel-air combination after first communication with the ultra-lean combustion-initiating device;

scavenging the combusted fuel-air combination after an expansion cycle.

34. A method for reducing exhaust pollution emissions in a two-stroke sliding vane internal combustion engine, having vanes that slide with at least one of a radial and axial component of vane motion, and incorporating effectual levels of exhaust gases, or diluent gases other than fresh air, in an intake charge, the method comprising the steps of:

inducting a highly-diluted fuel-air combination into a vane cell at an equivalence ratio less than 1.0 and a dilution ratio less than 0.65, and at a location such that a circumferential distance at mid-cell-height from injection to a stator site at the onset of combustion is at least about 4 times a vane cell height at intake;

compressing the highly-diluted fuel-air combination while mixing to a dimensionless concentration fluctuation fraction of less than 0.25;

combusting the highly-diluted, mixed fuel-air combination;

scavenging the combusted fuel-air combination after an expansion cycle.

35. A method for reducing exhaust pollution emissions in a two-stroke sliding vane internal combustion engine, having vanes that slide with at least one of a radial and axial component of vane motion, and incorporating effectual levels of exhaust gases, or diluent gases other than fresh air, in an intake charge, the method comprising the steps of:

inducting a highly-diluted fuel-air combination into a vane cell at an equivalence ratio less than 1.0 and a dilution ratio less than 0.65, and at a location such that a circumferential distance at mid-cell-height from injection to an ultra-lean combustion-initiating device is at least about 4 times a vane cell height at intake;

compressing the highly-diluted fuel-air combination while mixing to a dimensionless concentration fluctuation fraction of less than 0.25;

combusting the highly-diluted, mixed fuel-air combination after first communication with the ultra-lean combustion-initiating device;

scavenging the combusted fuel-air combination after an expansion cycle.

* * * * *

UNITED STATES PATENT AND TRADEMARK OFFICE

CERTIFICATE OF CORRECTION

PATENT NO. : 5,836,282

DATED : November 17, 1998

INVENTOR(S) : Brian D. Mallen and Robert E. Breidenthal, Jr.

It is certified that error appears in the above-identified patent and that said Letters Patent is hereby corrected as shown below:

On the title page, Item [75],

Inventor: after "Brian D. Mallen, Charlottesville, Va." insert --Robert E. Breidenthal, Jr., Seattle, Wa.--

Assignee: delete "Samsung Electronics Co., Ltd., Suwon, Rep. of Korea" and insert thereof --Mallen Research Ltd. Partnership, Charlottesville, Virginia--

Item [19] should read --Mallen et al.--

Signed and Sealed this

Thirteenth Day of July, 1999

*Attest:*

*Attesting Officer*

Q. TODD DICKINSON

*Acting Commissioner of Patents and Trademarks*